US005176974A

United States Patent [19]

Till et al.

[11] Patent Number: 5,176,974

[45] Date of Patent: Jan. 5, 1993

[54] IMAGING APPARATUSES AND PROCESSES

[75] Inventors: Henry R. Till, Paoli, Pa.; Harold M. Anderson, Rancho Palos Verdes, Calif.; Gerald A. Domoto; Aron Sereny, both of New York, N.Y.; Joseph M. Crowley, Morgan Hill, Calif.; Richard G. Crystal, Los Altos, Calif.; John C. Knights, Palo Alto, Calif.; Rodney B. Proulx, Downingtown, Pa.; Nicholas K. Sheridon, Saratoga; John M Lennon, Newark, both of Calif.; Stephan Drappel, Toronto, Canada

[73] Assignee: Xerox Corporation, Stamford, Conn.

[21] Appl. No.: 422,201

[22] Filed: Oct. 16, 1989

[51] Int. Cl.[5] ..... G03G 13/01

[52] U.S. Cl. ..... 430/42; 430/31; 430/53; 430/98; 430/117; 430/126; 346/159

[58] Field of Search ..... 430/42, 256, 257, 46, 430/47, 124, 126, 31, 32, 33, 53, 97, 98, 110, 112, 114, 117; 346/159

[56] References Cited

U.S. PATENT DOCUMENTS

| | | | |
|---|---|---|---|
| 3,084,043 | 5/1959 | Gundlach | 96/1 |
| 3,672,887 | 8/1970 | Matsumoto et al. | 96/1.2 |
| 3,687,661 | 8/1972 | Sato et al. | 96/1.2 |
| 3,701,464 | 10/1972 | Crum | 226/3 |
| 3,843,538 | 10/1974 | Vermeulen et al. | 252/62.1 |
| 3,927,934 | 12/1975 | Cook | 355/3 R |
| 3,937,572 | 2/1976 | Gaynor et al. | 355/16 |
| 4,021,106 | 5/1977 | Gaynor | 355/3 R |
| 4,286,031 | 8/1981 | Kuehnle et al. | 430/44 |
| 4,304,836 | 12/1981 | Cheema et al. | 430/257 |
| 4,353,970 | 10/1982 | Dryczynski et al. | 430/31 |
| 4,395,472 | 7/1983 | Robillard | 430/47 |
| 4,403,848 | 9/1983 | Snelling | 355/4 |
| 4,485,982 | 12/1984 | St. John et al. | 242/57.1 |
| 4,497,570 | 2/1985 | Bolte et al. | 355/16 |
| 4,569,584 | 2/1986 | St. John et al. | 355/14 R |
| 4,600,669 | 7/1986 | Ng et al. | 430/47 |
| 4,659,640 | 4/1987 | Santilli | 430/119 |
| 4,660,059 | 4/1987 | O'Brien | 346/157 |
| 4,725,867 | 2/1988 | Ng et al. | 355/4 |
| 4,731,622 | 3/1988 | Nicks et al. | 346/157 |
| 4,756,985 | 7/1988 | Haneda et al. | 430/42 |
| 4,766,053 | 8/1988 | Shinozaki et al. | 430/256 |
| 4,935,324 | 6/1990 | Grushkin et al. | 430/110 |
| 4,960,667 | 10/1990 | Wong et al. | 430/414 |

FOREIGN PATENT DOCUMENTS

| | | |
|---|---|---|
| 926182 | 5/1973 | Canada . |
| 937823 | 12/1973 | Canada . |
| 942554 | 2/1974 | Canada . |
| 1312844 | 4/1973 | United Kingdom . |
| 1321286 | 6/1973 | United Kingdom . |

OTHER PUBLICATIONS

Xerox Disclosure Journal, "Color Xerography With Intermediate Transfer", J. R. Davidson, vol. 1, No. 7, Jul. 1976, p. 29.

"Film, Toning Ink. and Process in the *Kodak Signature* Color Proofing System", M. R. Specht et al., The Third International Congress on Advances in Non-Impact Printing Technologies, 1986.

*Primary Examiner*—Marion E. McCamish
*Assistant Examiner*—Kathleen Duda
*Attorney, Agent, or Firm*—Judith L. Bynrick

[57] ABSTRACT

Disclosed are ionographic imaging apparatuses and processes. One apparatus comprises an imaging means, means for applying to the imaging means a liquid material capable of forming a dielectric peel layer adhering to the imaging means, ionographic writing means for generating a latent image on the peel layer, means for developing the latent image on the peel layer, and means for simultaneously transferring the peel layer bearing the developed image from the imaging means to a substrate and affixing the peel layer bearing the developed image to the substrate. In another embodiment, the apparatus employs a process which comprises applying to an imaging means a liquid material capable of forming a dielectric peel layer adhering to the imaging means, forming a first latent image on the peel layer with an ionographic writing means, developing the first latent image with a first developer, forming a second latent image on the peel layer containing the first developed image with an ionographic writing means, developing the second latent image with a second developer, forming a third latent image on the peel layer containing the first and second developed images with an ionographic writing means, developing the third latent image with a third developer, and simultaneously transferring the portion of the peel layer that bears the developed images to a substrate and affixing the peel layer bearing the developed images to the substrate. A further embodiment is directed to an apparatus and process for sequentially forming and developing primary color images on an imaging means to form a full color image, followed by trasnsferring the fully formed image to a substrate, wherein the developers employed contain a release agent.

57 Claims, 5 Drawing Sheets

IMAGING APPARATUSES AND PROCESSES

BACKGROUND OF THE INVENTION

The present invention is directed to imaging apparatuses and processes. More specifically, one embodiment of the present invention is directed to a process wherein a latent ionographic image is formed on an imaging means with a peel layer, the latent image is developed with a developer, and the peel layer containing the developed image is simultaneously removed from the imaging means and transferred to a substrate. In another embodiment, a first latent image may be formed on the peel layer and developed with a first developer of one color, followed by formation of a second latent image on the imaging peel layer and development of the second latent image with a second developer of a color different from that of the first developer, and, if desired, followed by subsequent image formation and development steps to form an image of the desired number of colors, followed by simultaneous removal and transfer of the peel layer containing the developed image from the imaging means to a substrate. Images of two or more colors can thus be formed with the apparatuses and processes of this embodiment of the invention.

Another embodiment of the invention entails formation of a latent image on an imaging means, development of the latent image with a transparent waxy toner, which may be either a liquid toner or a dry toner, to form wax images on the imaging means, subsequently forming a second latent image on the wax images, and developing the second latent image with a colored developer. This process may be repeated by forming a third latent image on the wax images, followed by development of the third latent image with a developer of a color different from that of the first colored developer, followed by repeating the process to form fourth and additional images. The wax images containing the developed images are subsequently simultaneously transferred to and affixed to a substrate.

Another embodiment of the invention entails formation of a first latent image on an imaging means and development of the first latent image with a first liquid developer, followed by formation of a second latent image on the imaging means containing the first developed image and development of the second latent image with a second liquid developer, wherein the liquid medium of the first and second liquid developers comprises a volatile liquid and a nonvolatile liquid, so that subsequent to development, a residual oil film remains between the imaging means and the colored particles of the developer, thereby facilitating transfer of the developed image from the imaging means to the substrate. In this embodiment, the imaging means may optionally bear a peel layer.

Still another embodiment of the present invention entails formation of a latent image on an imaging means and development of the latent image with a liquid developer comprising a liquid medium, toner particles, a waxy release agent, and a charge control agent, followed by repetition of the process to form at least one additional image of a color different from the first image on top of the first image, wherein the waxy component of the liquid developers forms a peel layer between the imaging means and the toned images, thereby facilitating transfer to a substrate. The liquid developers can either contain toner particles and separate transparent particles of the waxy release agent, or they can contain toner particles comprising a colorant and a waxy release agent.

Yet another embodiment of the present invention entails ionographic formation of a latent image on an imaging means, development of the latent image with a dry toner comprising toner particles and a waxy release agent, and affixing of the developed image to the imaging means, followed by repetition of the process to form at least one additional image of a color different from the first image on top of the first image, wherein the waxy component of the dry toners forms a peel layer between the imaging means and the toned images, thereby facilitating transfer to a substrate. The dry toner can either comprise toner particles and separate transparent particles of the waxy release agent, or it can comprise toner particles comprising a colorant and a waxy release agent.

In ionographic imaging processes, a latent image is formed on a dielectric image receptor or electroreceptor by ion deposition, as described, for example, in U.S. Pat. Nos. 3,564,556, 3,611,419, 4,240,084, 4,569,584, 2,919,171, 4,524,371, 4,619,515, 4,463,363, 4,254,424, 4,538,163, 4,409,604, 4,408,214, 4,365,549, 4,267,556, 4,160,257, and 4,155,093, the disclosures of each of which are totally incorporated herein by reference. Generally, the process entails application of charge in an image pattern with an ionographic writing head to a dielectric receiver that retains the charged image. The image is subsequently developed with a developer capable of developing charge images.

Processes for forming images with dielectric materials are known. For example, U.S. Pat. No. 4,395,472, the disclosure of which is totally incorporated herein by reference, discloses a process for developing monochromatic or polychromatic photographic images directly on plain paper by a photodielectric selective sublimable dye transfer process. A photosensitive belt containing a photodielectric material and a binder is exposed to a light image, and the exposed areas are then passed in contact with a plain paper together with a carrier of sublimable dye under pressure and the application of an electromagnetic field. Multicolor images are formed by exposing the original through three separation filters, such as red, blue, and green, on three succesive areas of the photosensitive belt, and each exposed area is passed in contact with a plain paper and three successive carriers of sublimable dyes of color corresponding to the separation filters. The belt is coated on the outer surface with a photodielectric layer. Suitable binders for the photodielectric compositions include binders of low dielectric losses, such as butadiene, styrene, butadiene copolymers, nylon, silicon resins, and the like.

In addition, U.S. Pat. No. 4,353,970, the disclosure of which is totally incorporated herein by reference, discloses a method and apparatus for charging a dielectric layer electrostatically to a predetermined potential. In various embodiments, the dielectric layer may consist of a photoconductive and/or thermoplastic recording base, during the charging of which at least one of an A.C. or D.C. voltage field is modulated to apply a stream of ions to the charged dielectric layer. Further, U.S. Pat. No. 4,403,848 discloses an electronic color printing system with multiple scanning beams, each modulated in accordance with distinct color image signals. The photoreceptor for the system preferably comprises an inner layer or substrate composed of a suitable flexible electrically conductive substrate with an outer photoconductive layer. The photoreceptor material may further consist of a transparent polymer overcoating containing a charge transport compound. Each color image is developed prior to scanning of the photoreceptor by the next color image signal beam. Following development of the last color image, the composite color image is transferred to a copy sheet. Another method of preparing multicolor images is disclosed in U.S. Pat. No. 4,286,031, the disclosure of which is totally incorporated herein by reference, which discloses a printing method and apparatus in which an elongated substrate such as a strip, fabric, synthetic resin sheeting, foil, or the like is printed with a plurality of patterns from multiple independent color stations to achieve a composite multi-colored image.

Another process for forming full color images is illustrated in *Color Xerography With Intermediate Transfer*, Xerox Disclosure Journal, Vol. 1, No. 7 (July 1976), which discloses an apparatus having four photoreceptors and corresponding development systems and operates by sequentially forming and developing images on the photoreceptors, followed by transfer of each image in registration with the other images to an intermediate transfer member. The fully formed color image on the transfer member is then transferred to a substrate.

The use of liquid developers in imaging processes is known. For example, U.S. Pat. No. 3,843,538 discloses a developer emulsion comprising a disperse water phase and a continuous phase which is a solution of a pigmented high molecular weight polymer dissolved in an appropriate organic solvent. The emulsion is non-conductive, and may also be stabilized by a surface-active emulsifying agent with a predetermined hydrophilic-lipophilic balance. The liquid component of the emulsion is a solution of polymer resins in an organic solvent of about 90 percent Isopar® G and 10 percent aromatic hydrocarbons. A release agent, such as polyethylene wax, may be added to assist image transfer. The aqueous component allows for reduction in the amount of isoparaffin solvent which must be evaporated from the photoconductor after transfer. In addition, U.S. Pat. No. 4,659,640, the disclosure of which is totally incorporated herein by reference, discloses a liquid developer containing a volatile liquid carrier, wax, and polyester toner particles. The developer is self-fixing at room temperature as a result of the high wax concentration. Isopar® G is a preferred liquid carrier, and Epolene is a preferred polyethylene wax.

Further, M. R. Specht, L. Contois and D. Santilli, "Film, Toning Ink and Process in the Kodak Signature Color Proofing System," *Third International Congress on Advances in Non-Impact Printing Technologies* (Aug. 24–28, 1986) discloses an apparatus that employs a multilayered sheet comprising a 7-mil polyethylene terephthalate film support, a transparent conductive layer, a transparent photoconductor layer, and an overcoat layer. Each transparent original is rear exposed through the transparent layers with UV-blue light and developed with a liquid developer on the overcoat layer. After drying, subsequent color separation images are formed in the same manner directly over the developed image of previously formed color separations. When the complete image is formed, it is transferred with the overcoat layer to coated press stock with a heat/pressure laminator.

Additionally, U.S. Pat. No. 4,725,867 discloses an electrophotographic apparatus for forming a subsequent toner image overlapping one or more toner images previously formed on the surface of an electrophotographic element. The apparatus includes means for electrically charging the surface and the previously formed toner image or images, and means for forming an electrostatic latent image overlapping the previously formed toner image or images on the surface by imagewise exposing the element, through the previously formed toner image or images. The latent image forming means provides actinic radiation of a wavelength outside the range of 400 to 700 nanometers with the density of the previously formed toner image or images to the actinic radiation being less than about 0.2.

Further, U.S. Pat. No. 4,600,669 discloses an electrophotographic proofing element comprising a photoconductive layer on an electrically conducting substrate, capable of transmitting actinic radiation to which the photoconductive layer is responsive, and a dielectric support releasably adhered to the substrate comprising the photoconductive layer or an overcoat thereof forming a surface of the element capable of holding an applied electrostatic charge. To use the element, the surface of the dielectric support is charged and the photoconductive layer is imagewise exposed to actinic radiation, thereby forming a developable electrostatic image on the dielectric surface. The electrostatic image, in turn, is developed with toner to form a first color image. A composite color image is formed on the element by repeating the sequence one or more times with imagewise exposure of the photoconductive layer to actinic radiation transmitted through the transparent support, and developing over each preceding image with a different color toner. The composite toner image is transferred with the dielectric support to a receiving element to form a color copy such as a three-color filter array or a color proof closely simulating the color print expected from a full press run.

In addition, U.S. Pat. No. 4,659,640 discloses a liquid developer containing a volatile, electrically insulating carrier liquid, polyester toner particles, and wax dispersed in the carrier. The wax-to-polyester weight ratio in the developer is sufficiently high to render the developer self-fixing at room temperature. The resulting images developed with the developer become fixed to surfaces without the need for externally applied heat.

Further, U.S. Pat. No. 4,660,059, the disclosure of which is totally incorporated herein by reference, discloses an apparatus in which a document is printed in at least two different colors. Ions are projected onto the surface of a receiving member to record at least two electrostatic latent images thereon. Each of the electrostatic latent images recorded on the receiving member is developed with different color marking particles, and the different color marking particles are transferred substantially simultaneously from the receiving member to the document to print the desired information thereon.

Additionally, U.S. Pat. No. 3,672,887 discloses a process for reproduction of a multicolor original in an electrophotographic development employing superimposed development of multiple electrostatic latent images present on an electrophotographic photosensitive layer which is provided with low photoconductivity for a certain wavelength region, and has increased photoconductivity in at least a part of the remaining wavelength region. At least one development is obtained with a toner having photoconductivity for light of the wavelength region in which the electrophotographic level has low photoconductivity.

Further, U.S. Pat. No. 3,687,661 discloses a color reproducing process in which a series of color toner images are sequentially developed in superposition upon the surface of a photoconductive plate. Between each development step, the plate is imaged by charging the plate to a potential of a first polarity in both the previously developed and non-developed regions. The charge accepted in the previously developed regions is then partially neutralized by applying thereto a second charge having a polarity opposite to that of the initial charge whereby the original charge in the previously developed regions is reduced to a level substantially equal to the potential in the non-developed region. The now uniformly charged plate is exposed to a light image containing additional input scene information relating to the next image to be developed.

Another reference, U.S. Pat. No. 4,497,570, discloses a printing machine having an operator removable housing comprising a photoconductive member with a web entrained about a portion thereof. A latent image is recorded on the photoconductive member and marking particles transported to the portion of the web entrained about the photoconductive menber. In this way, the latent image recorded on the photoconductive member attracts the marking particles to the web in image configuration. A copy sheet is advanced into contact with the marking particles on the web. The marking particles interposed between the web and the copy sheet are heated. After cooling, the copy sheet is separated from the web with the marking particles remaining affixed thereto.

Additionally, U.S. Pat. No. 3,927,934 discloses an electrostatographic reproduction machine having a web cassette which comprises separable portions for feeding a web between the photoreceptive surface and the developer means of the machine to provide a developed image on the web for subsequent transfer to suitable support material.

Further, U.S. Pat. No. 3,937,572 discloses an apparatus for inductive electrophotography in which a thin insulative film is applied to be in direct contact with a surface carrying an electrostatic image which has a potential sufficient for adherence by induction of toner to the insulative film but insufficient to discharge when in contact with or upon separation of the toned insulative film. When the surface is photoconductive, it is exposed before or after contact with the insulative film to a pattern of discharging radiation to form an electrostatic image thereon. As one form of image development, toner is applied to the insulative film while in direct contact with the imaged surface. Thereafter, the toner image may be transferred to a support member. Toning and toner transfer is repeated without further charge and without further exposure.

In addition, U.S. Pat. No. 4,021,106 discloses an electrostatic reproduction process wherein a transparent charged sheet of insulating material, such as a thin insulating film bearing a uniform electrostatic charge on one side thereof, or an electret, is placed against an electrostatically charged photoconductive surface on a suitable substrate to form a temporary composite. The photoconductive surface is then exposed to a light pattern and the free surface of the transfer sheet is developed to provide a visible image corresponding to the light pattern. This image is fixed on the transfer sheet or is transferred to a receiving sheet after the transfer sheet has been removed from the photoconductive surface. Further copies can be made by reapplying the transfer sheet to the photoconductive surface and redeveloping the free surface of the transfer sheet when in place on the photoconductive surface.

In addition, imaging systems such as those disclosed in U.S. Pat. Nos. 4,569,584; 4,485,982; 4,731,622 and 3,701,464, the disclosures of each of which are totally incorporated herein by reference, employ a process wherein color images are formed on top of each other on a dielectric paper.

Liquid developers have many advantages, and often result in images of higher quality than images formed with dry toners. For example, images developed with liquid developers can be made to adhere to paper without a fixing or fusing step, so there is no need to include a resin in the liquid developer for fusing purposes. In addition, the toner particles can be made very small without resulting in problems often associated with small particle powder toners, such as machine dirt which can adversely affect reliability, potential health hazards, limited crushability, and restrictions against the use of coarsely textured papers. Development with liquid developers in full color imaging processes also has many advantages, such as a texturally attractive print because there is substantially no height build-up, whereas full color images developed with dry toners often exhibit height build-up of the image where color areas overlap. In addition, full color imaging with liquid developers is economically attractive, particularly if the liquid vehicle containing the toner particles can be recovered economically and without cross contamination of colorants. Further, full color prints made with liquid developers can be made to a uniformly glossy or a uniformly matte finish, whereas uniformity of finish is difficult to achieve with powder toners because of variations in the toner pile height, the need for thermal fusion, and the like.

When full color images are formed by sequential imaging and development with different colored developers, the ability to maintain consistency of hue in the final image depends, in part, upon achieving good registration of the several primary color images needed to form the composed color. In many printers employing powder toners, the images are formed by formation of the latent image for the first primary color on an imaging member, developing the image, transferring the developed image to a substrate such as paper, and cleaning residual toner from the imaging member, followed by repetition of the process for the second and third primary colors and, optionally, with black, until the complete image is formed. The final image is then fused to the substrate.

In this process, achieving synchronous transfer or registration of the images to the paper, wherein each individual colored image is transferred to the desired position relative to the positions of the other individual colored images, is extremely difficult. The apparatus and process of the present invention provide a means for forming full color images with excellent registration, thus avoiding the difficulties encountered with many prior art processes wherein transfer of each developed image to a substrate occurs prior to formation and development of the next image.

Although known imaging processes are suitable for their intended uses, a need continues to exist for ionographic imaging processes that enable formation of prints of high image quality. A need also exists for ionographic imaging processes which enable formation of full color prints of high image quality and excellent registration. In addition, there is a need for ionographic imaging processes wherein the images formed and developed can be transferred to plain paper with a wide range of textures. There is also a need for ionographic imaging processes wherein full color images are formed with excellent registration. Further, a need exists for ionographic imaging processes wherein full color images are formed and developed with liquid developers, thereby enabling the formation of very high quality images. Additionally, there is a need for ionographic imaging processes wherein the prints formed have a uniformly glossy or uniformly matte finish. There is also a need for economically attractive ionographic imaging processes wherein an image is formed on a dielectric layer and developed with a developer, and the dielectric layer is subsequently transferred and affixed to a substrate. A need also exists for ionographic imaging apparatuses suitable for carrying out the processes of the present invention and having simplified machine architecture.

SUMMARY OF THE INVENTION

It is an object of the present invention to provide an ionographic imaging process which enables formation of prints of high image quality.

It is another object of the present invention to provide an ionographic imaging process which enables formation of full color prints of high image quality and excellent registration.

It is still another object of the present invention to provide an ionographic imaging process wherein the images formed and developed can be transferred to plain paper with a wide range of textures.

It is yet another object of the present invention to provide an ionographic imaging process wherein full color images are formed with excellent registration.

Another object of the present invention is to provide an ionographic imaging process wherein full color images are formed and developed with liquid developers, thereby enabling the formation of very high quality images.

Still another object of the present invention is to provide an ionographic imaging process wherein the prints formed have a uniformly glossy or uniformly matte finish.

Yet another object of the present invention is to provide an economically attractive ionographic imaging process wherein an image is formed on a dielectric layer and developed with a liquid developer, and the dielectric layer is subsequently transferred and affixed to a substrate.

It is still another object of the present invention to provide an ionographic imaging process wherein a latent image is formed on an imaging means and developed with a transparent waxy toner to form a wax image on the imaging means, followed by formation of a second latent image on the wax image and development of the second latent image with a liquid developer, and subsequently transferring the wax images containing the developed images to a substrate.

It is yet another object of the present invention to provide an ionographic imaging process wherein latent images formed on an imaging member are developed with a liquid developer containing a nonvolatile hydrocarbon component, thereby enhancing subsequent transfer to a substrate.

Still another object of the present invention is to provide an ionographic imaging process wherein latent images formed on an imaging member are developed with a developer containing a wax component, thereby enhancing subsequent transfer to a substrate.

Yet another object of the present invention is to provide ionographic imaging apparatuses suitable for carrying out the processes of the present invention and having simplified machine architecture.

These and other objects of the present invention are achieved by providing an imaging process which comprises providing an imaging means; applying to the imaging means a liquid material capable of forming a dielectric peel layer adhering to the imaging means; forming a latent image on the peel layer with an ionographic writing means; developing the latent image; contacting a substrate to the peel layer; and simultaneously transferring the peel layer containing the developed image from the imaging means to the substrate and affixing the peel layer containing the developed image to the substrate.

The present invention is directed to an ionographic process. In this embodiment, the imaging member is of either a conductive or an insulating material, and the latent image is formed by applying charge in imagewise fashion to the dielectric peel layer present on the imaging means with an ionographic writing head.

As used herein, the term "peel layer" refers to a layer of a dielectric material applied to the imaging means. The latent images are formed and developed on the peel layer, and the peel layer is subsequently simultaneously removed or "peeled" from the imaging member and transferred and affixed to a substrate, such as paper or transparency material. The peel layer can be applied in a single uniform layer or it can be applied only to areas of the imaging member wherein images are to be generated and developed.

DETAILED DESCRIPTION OF THE INVENTION

Figure 1:
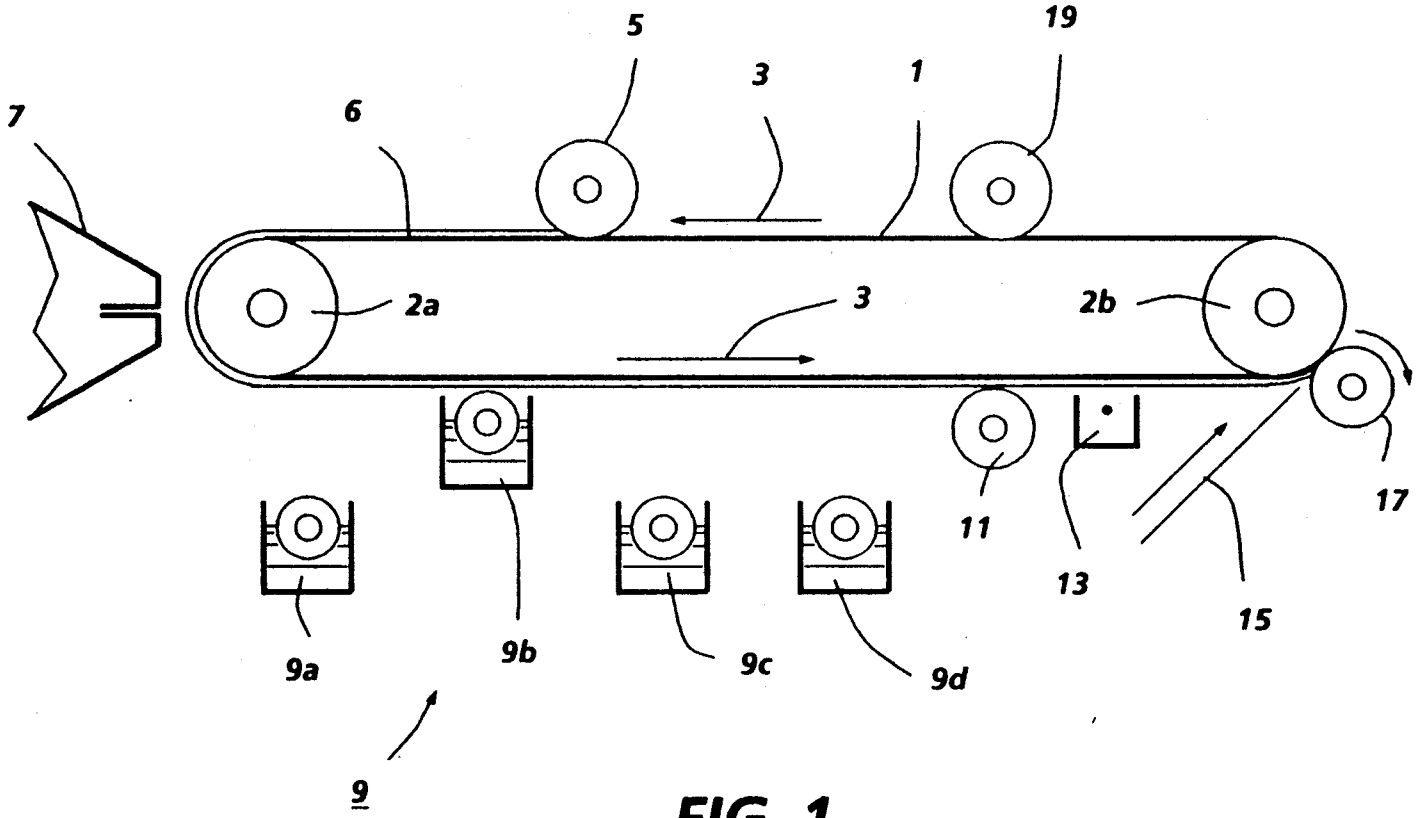
FIG. 1 illustrates schematically one machine configuration suitable for the processes of the present invention.

Illustrated in FIG. 1 is a schematic representation of one possible machine configuration suitable for an ionographic printing process of the present invention. Imaging means 1, which is an electroreceptor, is moving around tensioning rollers 2*a* and 2*b* in the direction indicated by arrows 3. A peel layer 6 is applied to the imaging means by applicator means 5, which may be a gravure roll, a doctor blade, or the like. The peel layer material generally is either in the form of a hot melt which cools and solidifies on the imaging means or is present in a solvent which subsequently evaporates, leaving a solid layer on the imaging means. Dispensing of peel layer material from applicator means 5 is ceased subsequent to laying down of the peel layer 6 by disengaging the applicator means, by ceasing rotation of the applicator means, or the like. Peel layer 6 subsequently receives a first latent image to be developed with a first color from ionographic or ionic projection writing head 7, which latent image is then developed with a first developer at one of a plurality of development stations 9*a*, 9*b*, 9*c*, and 9*d*; FIG. 1 illustrates development with station 9*b* engaged. For the process of the present invention, development may be either with a liquid developer or with a dry developer; as illustrated in FIG. 1, the process employs a liquid development process. When dry development is employed, the toned images are affixed to the peel layer by any suitable process, such as by application of heat, pressure, solvents or solvent vapors, combinations thereof, or the like. Subsequent to development, the toner particles adhere to the peel layer and the excess liquid medium from the liquid developer is removed by liquid removal means 11, which may be by any of several methods, such as a counter-rotating cylinder, an air shear, or the like. Any residual charge remaining on the imaging means is removed by charging means 13, which may be a corotron, RF or POW scorotron, or the like. When images of more than one color are desired, the imaging means again moves past ionic projection writing head 7, at which point another latent image is formed on peel layer 6 on top of the first developed image, and the latent image moves past development stations 9, where it is developed with a second liquid developer of a color different from that of the first developer at, for example, development station 9*a*. The process is repeated, with the subsequent latent images being developed at development stations 9*c* and 9*d*, until the final full color image has been formed. The developed images, if formed by a liquid developer, are permitted to dry on the peel layer prior to transfer and affixing to a substrate. If formed by a dry developer, the developed images are affixed to the substrate prior to formation of subsequent latent images and prior to transfer and affixing to a substrate. Subsequently, a substrate 15 is moved to a pressure pinch between tensioning roller 2*b* and pressure roll 17 in synchronism with the arriving fully formed image, where pressure, heat, and, optionally, shear are applied to transfer part or all of the image-bearing peel layer to the substrate. The peel layer may transfer entirely to the substrate, or it may split, so that the portion containing the image is transferred to the substrate and a portion remains on the imaging means. Subsequent to transfer of the peel layer to the substrate, excess peel layer material remaining on the imaging means 1 is removed by a cleaning means 19, which may be a heated roller, a blade cleaner, or the like, which cleaning means is engaged prior to cleaning and retracted subsequent to cleaning.

Figure 2:
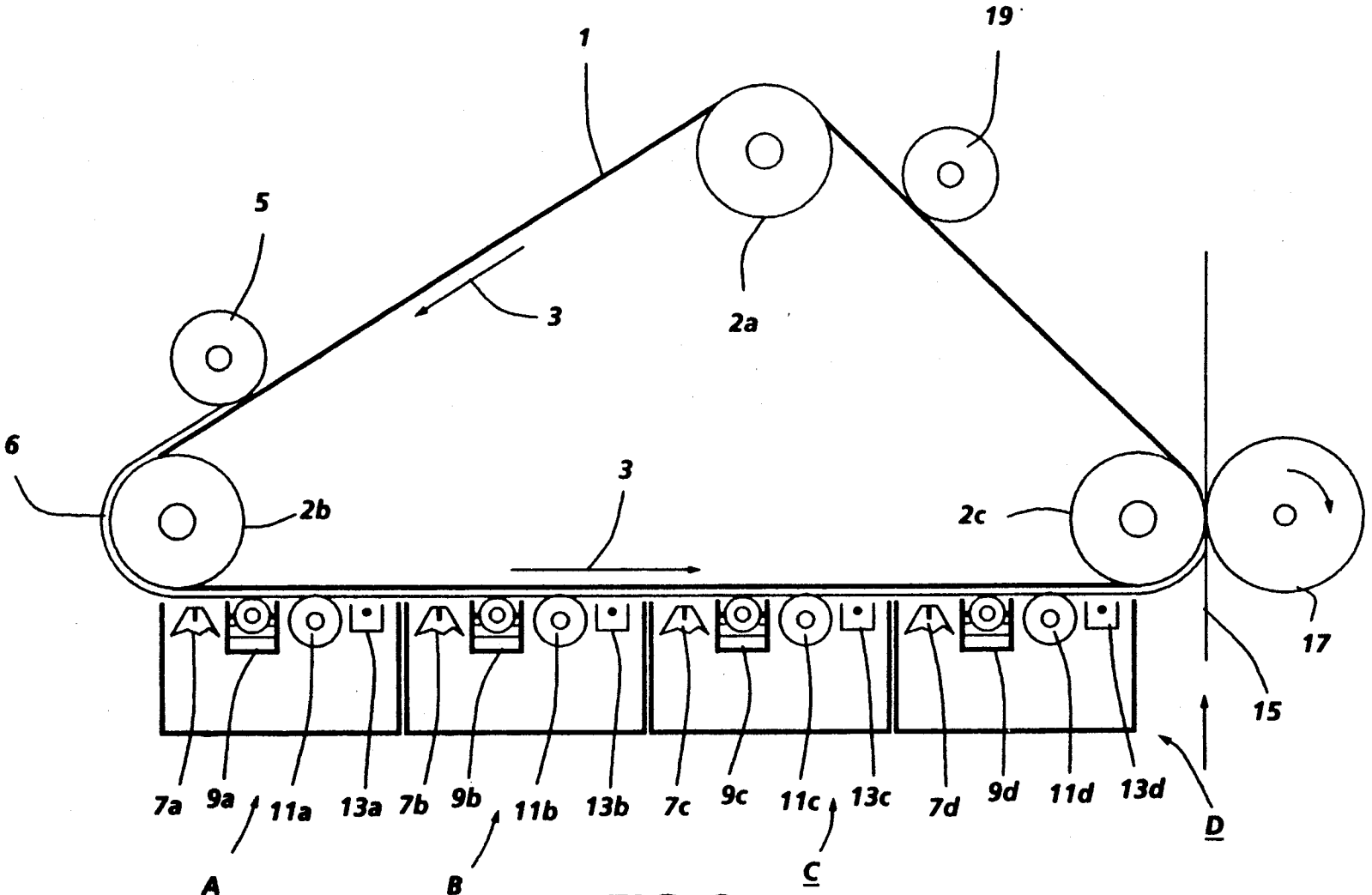
FIG. 2 illustrates schematically another machine configuration suitable for the processes of the present invention.

Another possible machine configuration for an ionographic process of the present invention is illustrated schematically in FIG. 2. As shown in FIG. 2, imaging means 1, which is an electroreceptor, is moving around tensioning rollers 2*a*, 2*b*, and 2*c* in the direction indicated by arrows 3. A peel layer 6 is applied to the imaging means by applicator means 5, which may be a gravure roll, a doctor blade, or any other suitable applicator. Dispensing of peel layer material from applicator means 5 is ceased subsequent to laying down of the peel layer 6 by disengaging the applicator means, by ceasing rotation of the applicator means, or the like. Peel layer 6 subsequently receives at station A a first latent image from an ionographic or ionic projection writing head 7*a* to be developed with a first color, which latent image is then developed with a first developer at a development housing 9*a* situated at station A. Development may be either with a liquid developer or with a dry developer; as illustrated in FIG. 2, the process employs liquid development. Stations A, B, C, and D each comprise an ionographic writing head 7*a*, 7*b*, 7*c*, and 7*d*, a liquid development housing 9*a*, 9*b*, 9*c*, and 9*d*, means, such as a solid porous roll, for removing excess liquid vehicle 11*a*, 11*b*, 11*c*, and 11*d*, a means to neutralize charge 13*a*, 13*b*, 13*c*, and 13*d*, and, optionally, means for conditioning the image such as, for example, a heating means (not shown). The present invention may be employed to form images of a single color, in which instance only one station need be present, to form two-color images, in which instance the number of stations can be from two to as many color choices as are desired, and to form multicolor or full color images, in which instance at least three stations are present to contain cyan, magenta, and yellow developers. Preferably, when full color images are formed, a fourth station is also present at which development of black images occurs with a black developer. FIG. 2 illustrates the embodiment of the present invention wherein four stations are employed. Additional stations can be present to form and develop highlight color images, images with custom colors such as silver and gold, and the like.

Subsequent to development at station A, the toner particles adhere to the peel layer and the excess liquid medium from the liquid developer is removed by liquid removal means 11*a*, which may be by any of several methods, such as a counter-rotating cylinder, an air shear, or the like, before the imaging means 1 proceeds to station B. When dry development is employed, no means for removing excess liquid medium is necessary; the dry developed image is affixed to the peel layer prior to proceeding to the next step in the process. Any residual charge on the imaging means is removed by a charging means 13*a* situated at station A, which may be a corotron, RF or POW scorotron, or the like. The imaging means then proceeds to station B, at which a second latent image is formed with an ionographic or ionic projection writing head 7*b* situated at station B, which image is then developed with a second liquid developer at a development housing 9*b* situated at station B. Again, when liquid development is employed, excess liquid medium from the liquid developer is removed by liquid removal means 11*b* (this element being absent and the developed image being affixed to the peel layer when dry development is employed) and any residual charge on the imaging means is removed by a charging means 13*b* situated at station B. The process is repeated at stations C and D until a final full color image has been formed with cyan, yellow, magenta, and black developers. The developed images, if formed by a liquid developer, are permitted to dry on the transparent wax image prior to transfer and affixing to a substrate. Subsequently, a substrate 15 is moved to a pressure pinch between tensioning roller 2*c* and pressure roll 17 in synchronism with the arriving fully formed image, where pressure, heat, and, optionally, shear are applied to transfer part or all of the image-bearing peel layer of the imaging means to the substrate. Subsequent to transfer of the peel layer to the substrate, excess peel layer material remaining on the imaging means 1 is removed by a cleaning means 19, which may be a heated roller, a blade cleaner, or the like, which cleaning means is engaged prior to cleaning and retracted subsequent to cleaning.

Figure 3:
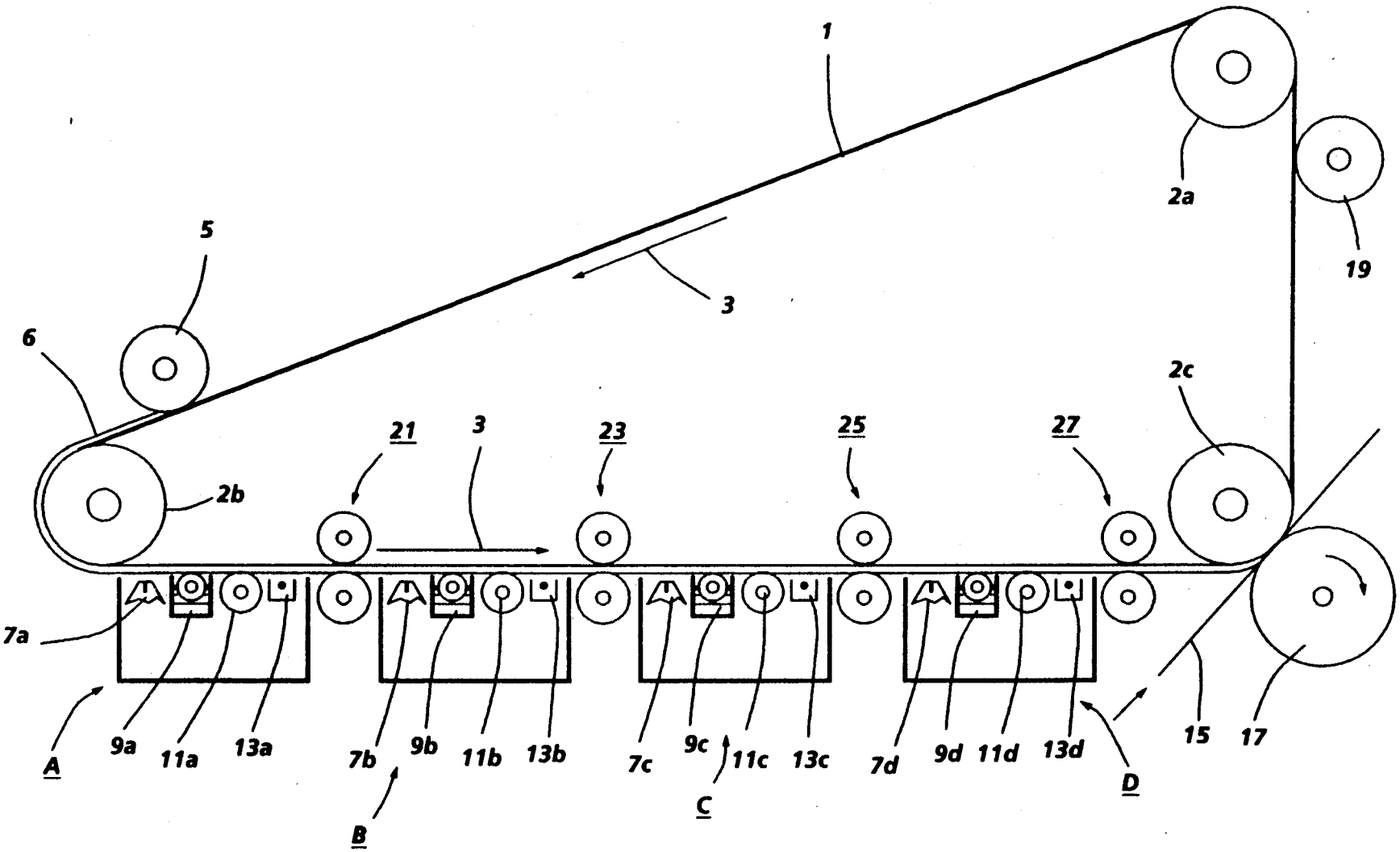
FIG. 3 illustrates schematically another machine configuration suitable for the processes of the present invention wherein images of one color are affixed to the peel layer subsequent to generation and development of additional images of another color.

In addition, when images of more than one color are generated according to the present invention, images of one color may be affixed to the peel layer prior to advancement of the imaging means to the next imaging station as illustrated, for example, in FIG. 3, which shows another ionographic process according to the present invention. As shown schematically in FIG. 3, imaging means 1, which is an electroreceptor, is moving around tensioning rollers 2*a*, 2*b*, and 2*c* in the direction indicated by arrows 3. A peel layer 6 is applied to the imaging means by applicator means 5, which may be a gravure roll, a doctor blade, or any other suitable applicator. Dispensing of peel layer material from applicator means 5 is ceased subsequent to laying down of the peel layer 6 by disengaging the applicator means, by ceasing rotation of the applicator means, or the like. Peel layer 6 subsequently receives at station A a first latent image from an ionographic or ionic projection writing head 7*a* to be developer with a first color, which latent image is then developed with a first developer at a development housing 9*a* situated at station A. Development may be either with a liquid developer or with a dry developer; as illustrated in FIG. 3, the process employs liquid development. Stations A, B, C, and D each comprise an ionographic writing head 7*a*, 7*b*, 7*c*, and 7*d*, a liquid development station 9*a*, 9*b*, 9*c*, and 9*d*, means, such as a solid porous roll, for removing excess liquid vehicle 11*a*, 11*b*, 11*c*, and 11*d*, and a means to neutralize charge 13*a*, 13*b*, 13*c*, and 13*d*. When dry development is employed, the liquid removal means is absent. The present invention may be employed to form images of a single color, in which instance only one station need be present with a single fusing apparatus situated after the station, to form two-color images, in which instance the number of stations can be from two to as many color choices as are desired, with fusing means situated after each station, and to form multicolor or full color images, in which instance at least three stations are present to contain cyan, magenta, and yellow developers, with fusing means situated after each station. Preferably, when full color images are formed, a fourth station is also present at which development of black images occurs with a black developer. FIG. 3 illustrates the embodiment of the present invention wherein four stations are employed. Additional stations can be present to form and develop highlight color images, images with custom colors such as silver and gold, and the like.

Any residual charge on the imaging means is removed by a charging means 13*a* situated at station A, which may be a corotron, RF or POW scorotron, or the like. Subsequently, the image generated and developed at station A is fused to the peel layer 6 by fusing means 21, which may be any suitable fusing means such as pressure rollers, heated rollers, radiant heat, solvent fusing, and the like. The imaging means then proceeds to station B, at which a second latent image is formed with an ionographic or ionic projection writing head 7*b* situated at station B, which image is then developed with a second dry developer at a development housing 9*b* situated at station B. Again, any residual charge on the imaging means is removed by a charging means 13*b* situated at station B. Subsequently, the image generated and developed at station B is fused to the peel layer 6 by fusing means 23, which may be any suitable fusing means. The process is repeated at stations C and D, with fusing occurring at fusing means 25, situated between station C and station D, and, optionally, at fusing means 27 situated after station D, until a final full color image has been formed with cyan, yellow, magenta, and black dry developers, at which point a substrate 15 is moved to a pressure pinch between tensioning roller 2*c* and pressure roll 17 in synchronism with the arriving fully formed image, where pressure, heat, and, optionally, shear are applied to transfer part or all of the image-bearing peel layer of the imaging means to the substrate. Subsequent to transfer of the peel layer to the substrate, excess peel layer material remaining on the imaging means 1 is removed by a cleaning means 19, which may be a heated roller, a blade cleaner, or the like, which cleaning means is engaged prior to cleaning and retracted subsequent to cleaning.

The imaging means may be in the configuration of a web or belt, as shown in the Figures, or in the configuration of a drum or a plate. The imaging means is an electroreceptor which generally comprises a layer of a dielectric material and a layer of a conductive material. In some embodiments of the present invention, the electroreceptor comprises an imaging means with a conductive layer and a dielectric layer to which is applied the dielectric peel layer. In other embodiments of the present invention, the electroreceptor comprises an imaging means of a conductive layer to which is applied the dielectric peel layer. For example, the electroreceptor can comprise a conductive layer of a material such as nickel in a thickness of about 2 mils, coated with a compliant conductor of a material such as Viton®, vinylidene fluoride-based fluoroelastomers which contain hexafluoropropylene as a comonomer, available from E. I. DuPont de Nemours and Company, which fluoroelastomer contains conductive carbon particles in an amount sufficient to provide the layer with a bulk resistivity of about $10^7$ ohm-cm or less, and, on top of the compliant conductor layer, a dielectric layer of a material such as Viton® that does not contain conductive particles. In this example, the compliant conductor layer enables intimate contact between the formed image and the substrate, which may be rough paper. Many dielectric materials exist and are suitable for the electroreceptors for the present invention; selection of the material is based on desired surface energy, ruggedness, resistance to environmental stresses, and the like. Examples of dielectric materials include polytetrafluoroethylene such as Teflon® (E. I. DuPont de Nemours & Company), fluorocarbon elastomers, including vinylidene fluoride-based fluoroelastomers which contain hexafluoropropylene as a comonomer, such as Viton® (E. I. DuPont de Nemours & Company), polyvinylidene fluoride, such as Kynar® (E. I. DuPont de Nemours & Company), polyvinyl fluoride, such as Tedlar® (E. I. DuPont de Nemours & Company), polycarbonates such as Lexan® and Makrolon®, polyesters such as Mylar® (E. I. DuPont de Nemours & Company), mixtures thereof, and the like. The electroreceptor material may also be of a material such as titanized or aluminized Mylar®, generally of a thickness of about one milli-inch, titanized or aluminized Kynar®, titanized or aluminized Tedlar®, titanized or aluminized Makrolon®, and the like. Further, the electroreceptor can be of any conductive material, such as those typically employed as the conductive layer of conventional photoreceptors, in embodiments of the present invention employing a peel layer that functions as the dielectric surface. The electroreceptor may have a capacitance of from about 100 to about 300 pF/cm$^2$ (picofarads per square centimeter), and preferably has a capacitance of about 200 pF/cm$^2$. The choice of capacitance is governed by the charge density produced by the ion source of the ionographic writing head, image effects that might result from too high a voltage, and the charge density and voltage requirements of the liquid developer and the development station. For example, when 30 n-c/cm$^2$ (nanocoulombs per square centimeter) is imposed upon an electroreceptor with a capacitance of 200 pF/cm$^2$, the resulting voltage is 150 volts, since $Q=CV$, wherein Q is charge, C is capacitance, and V is voltage. It is believed that voltages of less than 250 volts are preferred to produce dense ionographic images with liquid developers. Further information concerning dielectric imaging members is disclosed, for example, in U.S. Pat. No. 4,254,424, the disclosure of which is totally incorporated herein by reference.

The peel layer applied to the imaging means comprises a dielectric material that aids in the transfer of the fully formed image to the substrate. Generally, the peel layer can operate on one of three principles. First, it may split, for example approximately in half in the manner of inks transferred to paper in lithographic processes, so that the portion of the peel layer containing the developed image is transferred to the substrate, leaving behind a residual layer of the peel layer material on the imaging means. Second, the peel layer may be applied in a thickness of, for example, about 3 microns to an imaging means with a permanent dielectric layer of a thickness of, for example, about 10 microns, and may split at the junction of the peel layer with the imaging means, so that the layer is entirely transferred to the substrate and becomes a protective overlay for the image. Third, the peel layer may function as the dielectric portion of the electroreceptor and transfer fully with the image, in which instance the peel layer is applied to an imaging means that generally consists solely of a conductive layer; no permanent dielectric layer is present on the imaging means, and the peel layer, of a thickness of, for example, about 13 microns, functions as the dielectric material.

Any wax-like material that is capable of being applied to an imaging means, maintaining a latent image, supporting a developed latent image, and transferring and affixing to a substrate can be employed for the present invention. One example of a suitable peel layer material is a high molecular weight polyalkylene wax, such as polyethylene, preferably of a molecular weight of from about 500 to about 20,000, and more preferably from about 2,000 to about 10,000. Another example of a suitable material is a wax commerically available as Concord 5000 wax from Concord Chemical Company, Camden, N.J. Concord 5000 is a hard, white wax with a melting point of from about 212° to about 216° F. and exhibits a very low viscosity when melted. Other suitable waxes include Candellila Wax (commercially available from Strahl & Pitsch Company), polyethylene, polypropylene, paraffin waxes, microcrystalline wax C, and other waxes, such as the polyalkylenes Epolene N-10, Epolene N-12, and the like, available from Eastman Kodak Company, oxidized polyalkylene waxes such as oxidized polyethylene waxes, including A-C 629 and A-C 629A, available from Allied Signal Corporation, copolymers of ethylene and acrylic acid, such as A-C 580, available from Allied Signal Corporation, and the like as well as mixtures thereof. When waxes or polymers are employed, the layer is generally solid at room temperature. The solid peel layer material can optionally contain an additional ingredient such as a mineral oil, including Nujol, in an amount of up to about 10 percent by weight of the wax, filler particles such as silicon dioxide particles in an amount of up to 70 percent by weight of the wax, and the like. Mixtures of waxes and other additives can also be employed. For example, the peel layer material can comprise a mixture of a hydrolyzed polyethylene polymer such as Epolene C-16, commercially available from Eastman Kodak Company, a wax commercially available as Concord 5000 from Concord Chemical Company, Inc., and a mineral oil such as Nujol. In a mixture of this type, the polymer can be present in any amount from nearly zero to nearly 100 percent, and preferably is present in an amount of from about 60 to about 80 percent by weight, the wax can be present in any amount of from nearly zero to nearly 100 percent, and preferably in an amount of from about 15 to about 30 percent by weight, and the mineral oil can be present in any effective amount, preferably from nearly zero to about 10 percent by weight, and more preferably from about 5 to about 10 percent by weight. Additional ingredients may also be included in the peel layer materials. Examples of some additives that may be incorporated into the peel layer material include fatty acids, such as oleic acid, charge control agents such as OLOA 1200, commercially available from Chevron Chemical Company, basic barium patronate, lecithin, and other charge control agents known for use in liquid electrophotographic developers, and the like. The peel layer can be applied to the imaging means by any suitable method. Solid peel layers can be applied by heating the wax until it is in liquid form and applying it to the imaging means. Additionally, a solid peel layer can be applied by dissolving the peel layer in a solvent and solvent coating the material onto the imaging means, or applied by extrusion coating the peel layer material onto the imaging means. Other suitable means of coating can also be employed.

The peel layer can be of any effective thickness, and generally has a thickness of from about 1 to about 20 microns, and preferably from about 3 to about 6 microns, although other thicknesses may be selected. When the imaging means comprises a conductive layer and a permanent dielectric layer, the peel layer generally is applied in a thickness of from about 1 to about 6 microns. When the imaging means comprises only a conductive layer, with no permanent dielectric layer, the peel layer is generally applied in a thickness of from about 6 to about 20 microns.

When images on dielectric surfaces are developed with liquid developers, adhesion of the toner particles to the dielectric surface may be slow or rapid, depending on the dielectric material and the composition of the liquid developer. For example, for an image on a material such as selenium developed with some liquid developers comprising colored particles in a liquid vehicle such as an isoparaffinic hydrocarbon, adhesion does not occur immediately, and the toner particles can thus be easily transferred to a substrate such as uncoated paper, to which they will adhere. In contrast, for an image on a dielectric surface comprising a polymer with appropriate surface energy, such as polycarbonate polymers, polyesters such as Mylar®, and the like, when developed with a liquid developer comprising colored particles in a liquid vehicle such as an isoparaffinic hydrocarbon, the toner particles are likely to adhere rapidly to the dielectric surface. For the processes of the present invention, rapid adherence of the developed image to the dielectric surface is desirable, since the permanent image is formed on the dielectric material.

The latent image formed on the peel layer of the imaging means is developed with a developer, which may be either a dry toner or a liquid developer. Liquid developers, which are preferred for the present invention since they enable superior image quality, generally comprise colored particles and a liquid medium. Suitable liquid developers exhibit adhesion to the peel layer and to images previously developed with other liquid developers. In addition, suitable liquid developers form durable images on the substrate subsequent to fusing of the transferred images. Dry developers can also be employed, in the process of the present invention. When a dry developer is employed, the developed image is affixed to the imaging means prior to formation of subsequent latent images and also preferably prior to transfer and fixing to a substrate. The dry developed image is fused to the imaging means by any suitable process, such as application of heat, pressure, solvents, solvent vapors, or the like as well, as any combination thereof. Affixing the dry developed image to the imaging means results in reduced toner pile height, which enhances the iongraphic imaging process for forming additional latent images on the imaging means, particularly since ionographic writing heads typically are situated in close proximity to the imaging means. In addition, since a significant amount of air flow may exist where the ionographic writing head applies charge to the imaging means, affixing the dry developed image to the imaging means prior to subsequent imaging steps reduces or eliminates the likelihood that application of subsequent charge images to the imaging means will disturb previously developed images. Images developed with the developers employed generally are insulative or dielectric, so that additional ionographic images can be formed on top of previously developed images.

Subsequent to formation and development of the desired final image on the peel layer, the peel layer containing the image is simultaneously transferred and affixed to a substrate. Suitable substrates include plain paper, transparency materials, and the like. Transfer and fixing may be effected by any suitable means. For example, one method entails passing the substrate and the imaging means together through a transfer station, at which a pressure roller applies pressure to the peel layer and substrate. When the peel layer exhibits only marginal adhesion to the imaging means, pressure may be sufficient to transfer the peel layer to the substrate under the shear stress of the transfer nip. Transfer conditions can employ pressure and shear by placing the substrate and the peel layer on the imaging means in contact with each other and passing them through pressure rollers. Optionally, heat or thermal gradients can also be employed to assist transfer by reducing the viscosity of the peel layer; a thermal gradient can be employed to maximize the heat applied at the center of the peel layer, thereby minimizing viscosity and promoting splitting of the peel layer at that location during transfer, or to maximize the heat applied at the interface between the peel layer and the imaging means, thereby minimizing viscosity and promoting separation of the peel layer from the imaging means at that location during transfer. Additionally, the application of an electric field can assist transfer by electrostatic forces between the peel layer and the substrate. Compliance or lack of rigidity in the imaging means, the peel layer, the transfer roll, or any combination thereof, can further assist transfer to a substrate. Optionally, a clear adhesive layer can be applied to the completed image on the peel layer prior to transfer to promote adhesion of the peel layer to the substrate. Alternatively, the substrate can be a polymer coated paper that serves as an adhesive to promote transfer of the peel layer. Optionally, transfer may be enhanced by charging the final developed image with a corotron or scorotron and applying an electric field of a polarity opposite to that applied by the corotron or scorotron to the back of the substrate.

Typically, peel layers that split upon transfer to the substrate are of a material having low viscosity and low structural strength under the transfer conditions applied. Examples of splitting peel layers include viscous liquids, such as motor oil based hydrocarbons, including the oil commercially available as Magiesol from Magie Brothers Oil Company, Franklin Park, Ill. and an oil commercially available as Witsol® from Shell Chemical Company. This type of peel layer can be applied by means such as a doctor blade, a gravure roll, and the like in an effective thickness, generally from about 0.5 micron to about 2 microns. Solid peel layers can also be employed as splitting peel layers. Optimal transfer conditions for solid peel layers that split upon transfer entail application of heat to the peel layer to enhance transfer, followed by separation of the imaging means from the peel layer while the peel layer is still warm. Separation while the peel layer is still warm promotes splitting of the peel layer because the viscosity of the peel layer is lowered when it is warm, and is generally at its lowest in the middle section of the peel layer. During separation, the cohesive force of the warm peel layer material to itself is lower than both the adhesive force between the peel layer material and the substrate and the adhesive force between the peel layer material and the imaging means. Thus, the peel layer splits, the portion of the peel layer containing the developed image adheres to the substrate, and a thin layer of peel layer material also adheres to the imaging means. Preferably, a solid peel layer is caused to split upon transfer to the substrate by heating the peel layer during transfer to a temperature above the melting point of the peel layer material and separating the substrate from the imaging, meanwhile at least a portion of the peel layer is at a temperature above the melting point of the peel layer material. Separation while at least a portion of the peel layer is in the liquid state tends to promote splitting of the peel layer where the peel layer has its lowest viscosity, which generally is where the peel layer is in liquid form.

Peel layers that transfer fully from the imaging means to the substrate typically have high structural strength under the transfer conditions applied. Optimal transfer conditions for peel layers that transfer fully from the imaging means to the substrate entail application of heat, pressure, or other means to transfer the peel layer to the substrate, followed by separation of the imaging means from the peel layer after the peel layer has cooled if heat was applied to assist transfer. Separation after the peel layer has cooled promotes transfer of the entire peel layer because the viscosity of the peel layer is maximized after it has cooled. During separation, the cohesive force of the cool peel layer material to itself is higher than the adhesive force between the peel layer material and the imaging means. Thus, the peel layer separates entirely from the imaging means at the interface between the peel layer and the imaging means, and is transferred completely to the substrate. Preferably, a peel layer is caused to transfer fully to the substrate by separating the substrate from the imaging means while the peel layer is at a temperature lower than the melting point of the peel layer material. Separation while the peel layer is in the solid state tends to promote transfer of the entire peel layer, since the peel layer in its solid state will be most likely to have internal cohesive forces that can exceed both the adhesive force between the peel layer and the imaging means and the adhesive force between the peel layer and the substrate.

Application of heat can enhance transfer of the peel layer to the substrate. Heat may be applied in various ways. For example, one or both of the transfer rollers may be heated. In addition, radiant heat can be applied to the peel layer immediately prior to entering the transfer nip. Alternatively, radiant heat can be applied to the substrate surface as it enters the transfer nip. Further, the surface of the substrate may be heated conductively by an additional heated nip to the transfer roll as the substrate is about to enter the transfer nip. Additionally, heat can be applied to the peel layer containing the image by dielectric heating in the manner conventionally employed for sealing plastic bags. Additional information regarding the process of dielectric heating is disclosed in *Encyclopedia of Polymer Sciences and Technology*, volume 5, pages 1 to 23 (John Wiley & Sons), the disclosure of which is totally incorporated herein by reference. Further, heat can be applied to the conductive substrate of the imaging means by inductive heating in the manner conventionally employed for case hardening of gears. In this process, heat is generated by an induction coil through which is passed AC current at a frequency of, for example, about 500 KHz. Whether the peel layer transfers completely to the substrate or splits so that only a portion of the layer transfers, leaving behind a residual layer, can be controlled to some extent by the thermal gradient in the transfer nip. A high thermal gradient in the transfer nip can cause detachment of the peel layer from the imaging member at or near its junction with the imaging member, either by the effect of heat on the surface energy of the imaging means or by reduction in the viscosity of the peel layer at the junction, or both. The thermal gradient employed can minimize the viscosity at any desired depth within the peel layer, so that the peel layer splits as desired. For example, if the thermal gradient applied minimizes viscosity of the peel layer at a depth from the peel layer surface of one third of the peel layer thickness, upon transfer the layer will most likely split so that the top third of the layer adheres to the substrate and the bottom two thirds of the layer remain on the imaging means. For the process of the present invention, two or more methods of enhancing transfer can be employed in combination.

The finish of the transferred image can be controlled in part by the thickness of the peel layer on the imaging member. When the peel layer material has been applied thickly on the imaging means in a thickness of, for example, ¼ mil, the transferred image will generally have a glossy appearance. In situations where a matte finish is desired, a transferred peel layer thickness of about 1 micron or less is desirable, since the glossiness of an image with a peel layer of this thickness is likely to be determined by the finish of the substrate. In addition, to reduce image gloss further, the substrate bearing the image can be heated to a temperature sufficient to melt the peel layer material. Subsequent to transfer, the peel layer and the developed image generally at least partially penetrate the substrate surface. Heating the substrate and peel layer sufficiently to melt the peel layer promotes further penetration or absorption of the waxy material substrate, thereby reducing image gloss. Heating can be by any of several suitable means, such as convective heating, conductive heating, radiant heating, or microwave heating. Mechanical embossing of a glossy image can also be employed to produce a matte finish.

Subsequent to transfer of the peel layer to a substrate, the imaging means is preferably cleaned to remove excess peel layer material. Cleaning of the imaging means can be accomplished by any suitable method. For example, a heated roller can be placed in contact with the imaging means to melt and remove residual peel layer material. In addition, a blade may be placed in contact with the imaging means to remove residual peel layer material mechanically. Further, a solvent may be applied to the imaging means to dissolve residual peel layer material, followed by removal of the solvent and dissolved material by means such as an absorptive roller. Other cleaning means may be employed provided that the objectives of the present invention are achieved.

In situations wherein the images to be formed occupy a small fraction of the area of the page, as often occurs with text and business graphics, the consumables expenses for the process of the present invention can be reduced by applying peel layer material to the imaging means only in areas where images will be formed. This process also improves printing processes wherein the substrate to be imaged is of lesser width than the imaging means. By applying peel layer material only in areas to be imaged, consumables expenses are reduced and the burden on the cleaning means is reduced, since the cleaning means would otherwise have to remove a full thickness layer of untransferred peel layer material from those areas of the imaging means that extended beyond the width of the substrate.

Peel layer material can be applied selectively to those areas of the imaging means to be imaged by electrostatic lithography techniques. Prior to application of the peel layer, an electronic representation of the image to be produced is analyzed electronically. For example, if the original image is generated electronically, this representation is analyzed; if the original image is a hard copy, the image can be scanned into electronic memory and analyzed. Subsequently, a latent image in the form of a "mask" is applied to the imaging means which roughly corresponds to the areas to be imaged. Any suitable algorithm can be selected to accomplish this end; for example, the mask can be generated electronically by instructing the processing unit to form an image that extends one pixel beyond each image area to be formed. For example, when an image of a configuration similar to the following is desired:

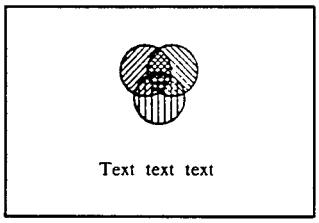

the latent image or "mask" might have the following configuration:

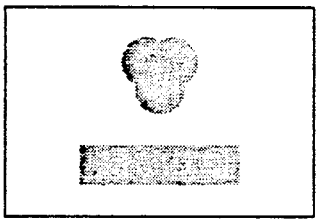

This latent image is then developed with the liquid material employed as the peel layer of the imaging means of the present invention by electrostatic lithographic techniques, wherein the liquid peel layer material is applied to a gravure roller or similar type applicator. When the applicator contacts the imaging means bearing the latent image, the liquid peel layer material is drawn out of the depressed areas of the applicator to the charged areas of the imaging means, thereby developing the latent image with the material. Processes for selective development of latent images with a liquid from a gravure roller or similar type applicator are disclosed in, for example, U.S. Pat. No. 3,084,043; Canadian Patents 937,823; 926,182 and 942,554; and British Patents 1,321,286 and 1,312,844. The disclosures of each of these patents are totally incorporated herein by reference.

To develop the mask image with the peel layer material, wherein the material is selectively attracted to the charged areas of the imaging means, the peel material can be rendered electrically conductive by the addition of conductive dopant materials, such as Shell ASA-3 in an amount sufficient to obtain a peel layer material with a conductivity in the liquid state of from about 100 to about 1,000 picomhos. When the material hardens or dries into the peel layer on the imaging means, the conductivity decreases, since the dopant ions are no longer able to move through the material, and the peel layer is thus suitable for the reception of latent images. Image formation then proceeds as described herein, wherein latent images are formed on the portions of the imaging means bearing the peel layer, the images are developed with a developer, and the peel layer containing the developed image is transferred to a substrate. In this embodiment, the peel layer may either be transferred entirely to the substrate, or it may split so that the top portion of the peel layer containing the developed image is transferred to the substrate and the remaining portion remains on the imaging means.

Other means may be employed for selectively applying the release layer to areas of the imaging means that will later be developed. For example, instead of laying down the peel layer over the entire imaging member prior to formation of latent images as shown in FIGS. 1 and 2, a latent image can be formed on the imaging means and developed with a transparent waxy toner to form a peel layer in the form of wax images on the imaging means. Subsequently, images are formed and developed on top of the wax images and the wax images containing the developed images are then simultaneously transferred and affixed to a substrate. This process is further illustrated in FIG. 4.

Figure 4:
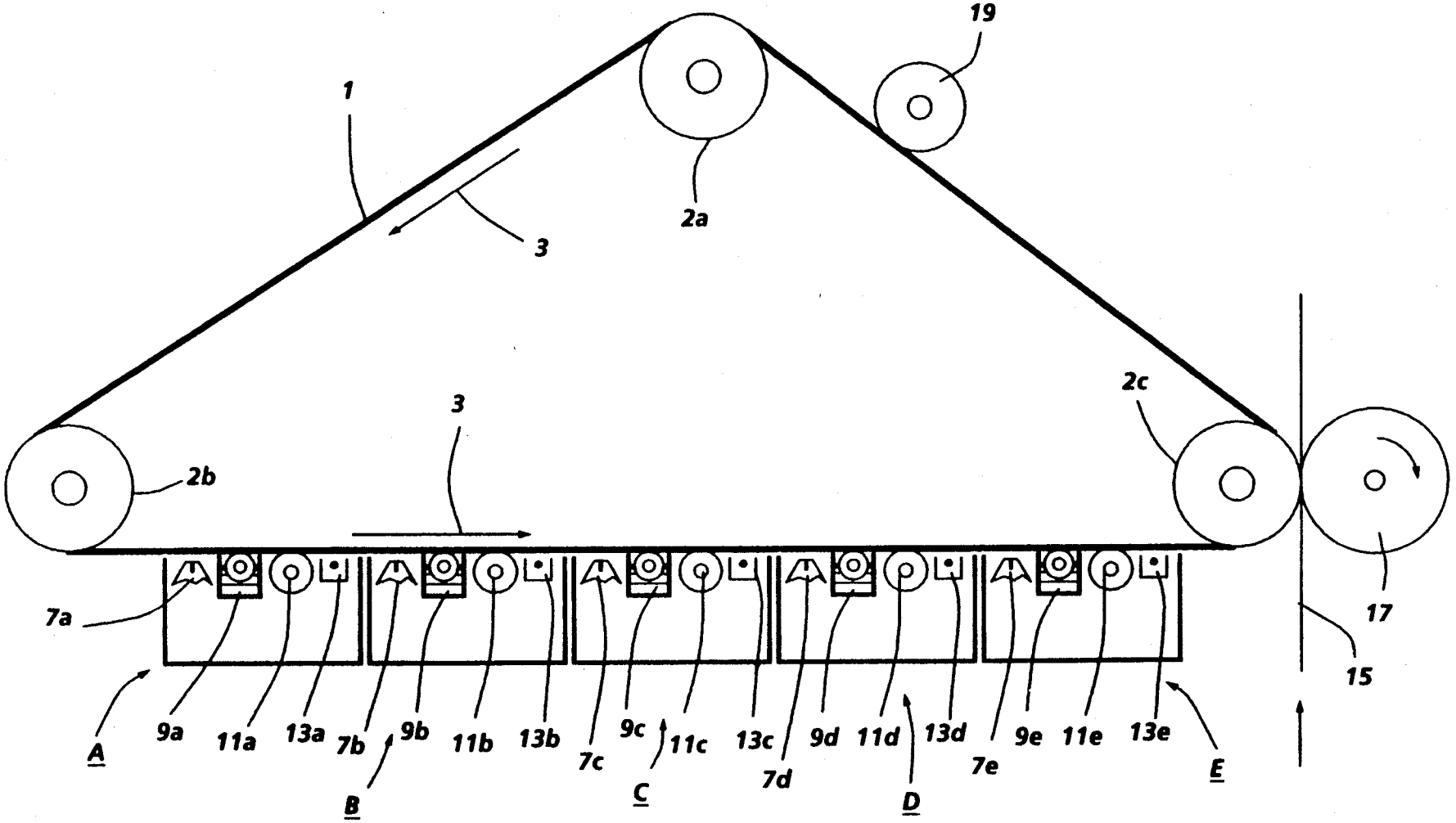
FIG. 4 illustrates schematically a machine configuration suitable for the processes of the present invention wherein the peel layer is selectively deposited on areas of the imaging means to be imaged by forming a latent image corresponding to said areas and developing said latent image with a transparent waxy toner.

As shown schematically in FIG. 4, imaging means 1, which is an electroreceptor, is moving around tensioning rollers 2*a*, 2*b*, and 2*c* in the direction indicated by arrows 3. At station A, which comprises an ionographic writing head 7*a*, a development station 9*a*, a liquid removal means 11*a*, and a means to neutralize charge 13*a*, a latent image corresponding in size and shape to the final full color image to be generated is formed on imaging means 1 with the ionographic writing head 7*a*. Subsequently, the latent image is developed with a transparent toner at the development station 9*a* at station A. The transparent toner may be either a liquid or a dry developer, and forms a wax image on areas of imaging means 1 bearing the latent image; as shown in FIG. 4, a transparent liquid developer is employed at station A. When a dry transparent toner is employed, the liquid removal means 11*a* is replaced with a fusing means (not shown), which may be any suitable fusing means, and preferably is a cold pressure fusing means. The transparent image formed on the imaging means is permitted to dry (when liquid development is employed) and becomes affixed to the imaging means prior to formation of latent images on the transparent image. Liquid transparent toners generally result in formation of a transparent image that is affixed to the imaging means simply by being allowed to dry; dry transparent toners generally must be fixed to the imaging means by heat, pressure, application of solvents or solvent vapors, a combination thereof, or the like to cause them to adhere to the imaging means. Any residual charge on the imaging means is removed by a charging means 13*a* situated at station A, whch may be a corotron, RF or POW scorotron, or the like. Subsequently, imaging means 1 bearing the wax image proceeds to station B, at which a second latent image is generated on the wax image by the ionographic or ionic projection writing head 7*b* at station B, which latent image is then developed with a first developer at a development housing 9*b* situated at station B. Stations B, C, D, and E each comprise an ionographic writing head 7*b*, 7*c*, 7*d*, and 7*e*, a development station 9*b*, 9*c*, 9*d*, and 9*e*, means, such as a solid porous roll, for removing excess liquid vehicle when liquid development is employed 11*b*, 11*c*, 11*d*, and 11*e*, a means to neutralize charge 13*b*, 13*c*, 13*d*, and 13*e*, and, optionally, means for conditioning the image such as, for example, a heating means (not shown). When dry development processes are employed, the liquid removal means is absent and is replaced with a fusing means. The present invention may be employed to form images of a single color, in which instance only one station need be present, to form two-color images, in which instance the number of stations can be from two to as many color choices as are desired, and to form multicolor or full color images, in which instance at least three stations are present to contain cyan, magenta, and yellow developers. Preferably, when full color images are formed, a fourth station is also present at which development of black images occurs with a black developer. FIG. 4 illustrates the embodiment of the present invention wherein four stations are employed. Additional stations can be present to form and develop highlight color images, images with custom colors such as silver and gold, and the like.

Subsequent to development at station B, the toner particles adhere to the wax image on imaging means 1 and, if liquid development was employed, the excess liquid medium from the liquid developer is removed by liquid removal means 11*b*, which may be any of several methods, such as a counter-rotating cylinder, an air shear, or the like, before the imaging means 1 proceeds to station C. Any residual charge on the imaging means 1 is removed by a charging means 13*b* situated at station B, which may be a corotron, RF or POW scorotron, or the like. The imaging means then proceeds to station C, at which a third latent image is formed with an ionographic or ionic projection writing head 7*c* situated at station C, which image is then developed with a second developer at a development housing 9*c* situated at station C. Again, if liquid development is employed, excess liquid medium from the liquid developer is removed by liquid removal means 11*c* and any residual charge on the imaging means is removed by a charging means 13*c* situated at station C. The process is repeated at stations D and E until a final full color image has been formed from cyan, yellow, magenta, and black developers. The developed images, when formed by a liquid developer, are permitted to dry on the transparent wax image prior to transfer and affixing to a substrate. When dry development is employed, each developed image is affixed to the imaging means prior to additional imaging steps and prior to transfer and affixation to a substrate. Subsequently, a substrate 15 is moved to a pressure pinch between tensioning roller 2*c* and pressure roll 17 in synchronism with the arriving fully formed image, where pressure, heat, and, optionally, shear are applied to transfer to the substrate the waxy areas of the imaging means containing the developed images. Subsequent to transfer of the images to the substrate, imaging means 1 is cleaned by a cleaning means 19, which may be a heated roller, a blade cleaner, or the like, which cleaning means is engaged prior to cleaning and retracted subsequent to cleaning.

The transparent toners suitable for forming the wax image in this embodiment of the present invention can be either liquid developers or dry developers. When a dry developer is employed, the developer generally can comprise particles of any material suitable as a peel layer material that is solid under imaging conditions, such as high molecular weight polyalkylene waxes, including polyethylene, preferably of a molecular weight of from about 500 to about 20,000, and more preferably from about 2,000 to about 10,000, Concord 5000 wax from Concord Chemical Company, Camden, N.J., hydrolyzed polyethylene polymers such as Epolene C-16, candellila wax, polyethylene, polypropylene, paraffin wax, microcrystalline wax C, polyalkyklenes such as Epolene N-10 and N-12, oxidized polyethylene waxes such as A-C 629 and A-C 629 A, copolymers of ethylene and acrylic acid, such as A-C 580, and the like, as well as mixtures of these waxes either with or without other additives such as Nujol or oleic acid. If the material selected does not exhibit desirable triboelectric charging characteristics, a charge control agent can be added to the material. Any suitable charge control agent can be employed, such as alkyl pyridinium halides, including cetyl pyridinium chloride, distearyl dimethyl ammonium methyl sulfate, charge control agents as disclosed in U.S. Pat. Nos. 4,464,452 and 4,480,021, the disclosures of each of which are totally incorporated herein by reference, and any other charge control agent suitable for dry electrophotographic toners. In addition, a material such as basic barium petronate, polyisobutylene succinimide, lecithin, and the like can be employed as the charge control agent. Generally, the dry toner can be prepared by conventional means, such as heating and mixing the ingredients, followed by the jetting, micronization, and classification steps generally employed in the electrophotographic art for preparing toner particles. Development can be by any method, including single component development and two-component development with a suitable carrier. When a dry developer is employed to form the peel layer mask on the imaging means, the developed transparent image is generally affixed to the imaging means prior to formation of the latent image thereon.

When the transparent toner used to form the wax images on the imaging means is a liquid developer, the developer comprises particles of a waxy release agent. The transparent liquid developers generally comprise a liquid vehicle, a charge control additive, and a waxy release agent. The liquid medium may be any of several hydrocarbon liquids conventionally employed for liquid development processes, such as hydrocarbons, including high purity alkanes having from about 6 to about 14 carbon atoms, such as Norpar® 12, Norpar® 13, and Norpar® 15, available from Exxon Corporation, and including isoparaffinic hydrocarbons such as Isopar® G, H, L, and M, available from Exxon Corporation, Amsco® 460 Solvent, Amsco® OMS, available from American Mineral Spirits Company, Soltrol®, available from Phillips Petroleum Company, Pagasol®, available from Mobil Oil Corporation, Shellsol®, available from Shell Oil Company, and the like. Isoparaffinic hydrocarbons are preferred liquid media, since they are colorless, environmentally safe, and possess a sufficiently high vapor pressure so that a thin film of the liquid evaporates from the contacting surface within seconds at ambient temperatures. Generally, the liquid medium is present in a large amount in the developer composition, and constitutes that percentage by weight of the developer not accounted for by the other components. The liquid medium is usually present in an amount of from about 80 to about 98 percent by weight, although this amount may vary from this range provided that the objectives of the present invention are achieved.

Examples of suitable charge control agents for liquid developers suitable for this embodiment of the invention include lecithin (Fisher Inc.); OLOA 1200, a polyisobutylene succinimide available from Chevron Chemical Company; basic barium petronate (Witco Inc.); zirconium octoate (Nuodex); aluminum stearate; salts of calcium, manganese, magnesium and zinc; heptanoic acid; salts of barium, aluminum, cobalt, manganese, zinc, cerium, and zirconium octoates; salts of barium, aluminum, zinc, copper, lead, and iron with stearic acid; and the like. The charge control additive may be present in an amount of from about 0.01 to about 3 percent by weight, and preferably from about 0.02 to about 0.05 percent by weight of the developer composition.

The waxy release agent component of the developer generally can be any material suitable as a peel layer material that is solid under imaging conditions, such as high molecular weight polyalkylene waxes, such as high molecular weight polyalkylene waxes, including polyethylene, preferably of a molecular weight of from about 500 to about 20,000, and more preferably from about 2,000 to about 10,000, Concord 5000 wax from Concord Chemical Company, Camden, N.J., hydrolyzed polyethylene polymers such as Epolene C-16, candellila wax, polyethylene, polypropylene, paraffin wax, microcrystalline wax C, Epolene N-10 and N-12, oxidized polyethylene waxes such as A-C 629 and A-C 629A, copolymers of ethylene and acrylic acid, such as A-C 580, and the like, as well as mixtures of these waxes either with or without other additives such as Nujol or oleic acid. Generally, the particles of waxy release agent are present in the developer in an effective amount, preferably from about 0.5 to about 4 percent by weight.

The liquid transparent developer generally can be prepared by heating and mixing the ingredients, followed by grinding the mixture in an attritor in the presence of the selected liquid medium. Subsequently, the charge control agent is added to the mixture to yield the transparent liquid developer. An example of a specific liquid transparent developer suitable for forming wax images in this embodiment of the present invention comprises particles comprising about 60 percent by weight of a hydrolyzed polyethylene polymer, about 20 percent by weight of candellia wax, and about 20 percent by weight of oleic acid suspended in a liquid isoparaffinic hydrocarbon vehicle such as Isopar® G to a concentration of about from about 0.5 to about 4 percent by weight solids. The liquid developer also contains a charge control agent such as OLOA 1200 in an amount of about 0.5 percent by weight of the solids content of the developer. When liquid development onto an aluminized Mylar® imaging member is effected with this developer at +250 volts, a uniform layer of transparent toner is formed on the imaging means after the transparent image has dried on the imaging means. Subsequently, images can be formed and developed on the dried layer formed by the transparent toner, and the layer containing the developed images can be transferred to a substrate by application of heat and pressure.

Figure 5:
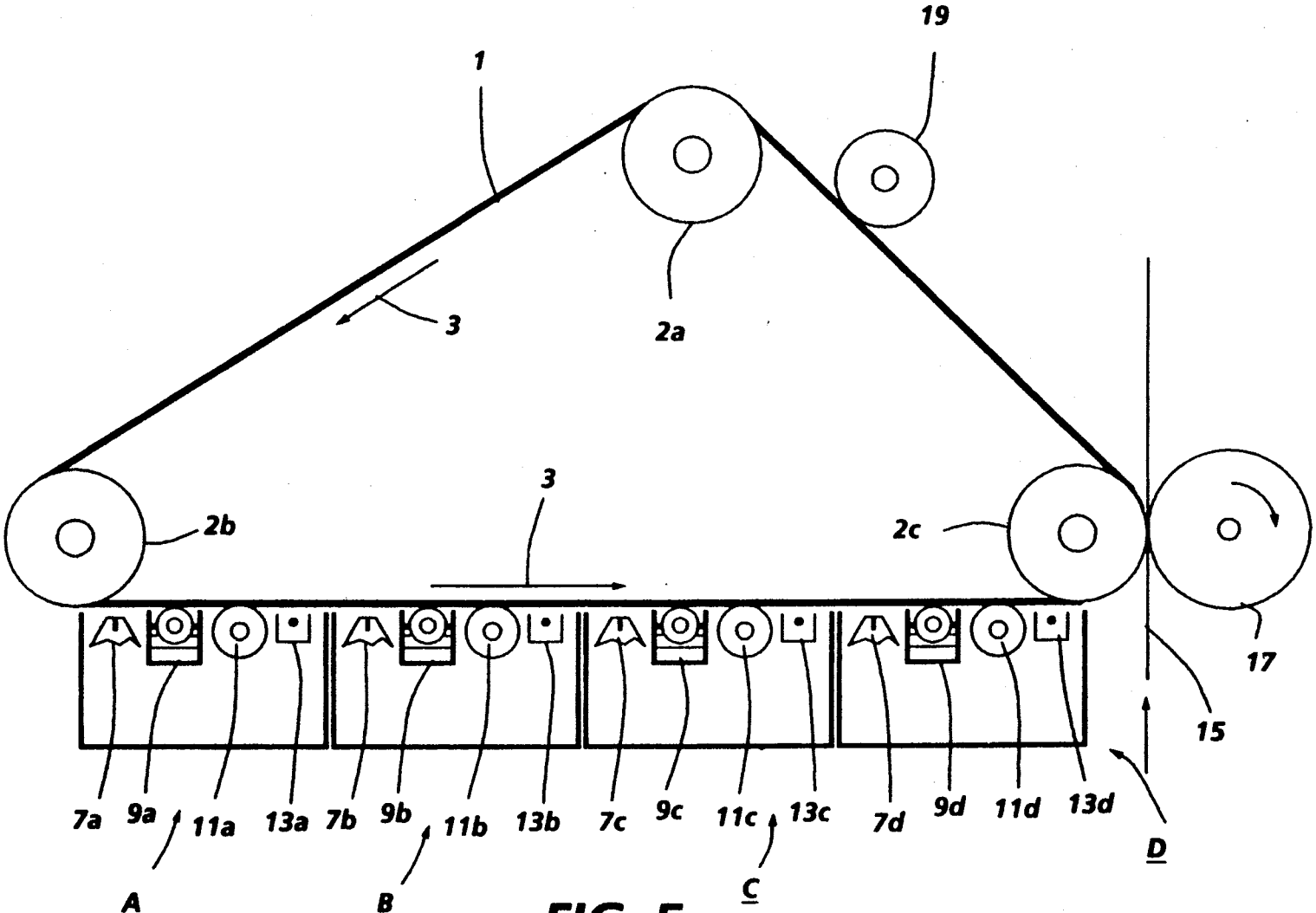
FIG. 5 illustrates schematically a machine configuration suitable for the processes of the present invention wherein latent images formed on the imaging means are developed with developers containing a release agent.

Another process for selectively applying a release agent only to areas of the imaging means to be developed entails incorporating a release agent into developers employed to develop the latent images. This process is further illustrated in FIG. 5. As illustrated in FIG. 5, imaging means 1, which is an electroreceptor with a dielectric surface capable of receiving a latent image, is moving around tensioning rollers 2*a*, 2*b*, and 2*c* in the direction indicated by arrows 3. Imaging means 1 subsequently receives at station A a first latent image from an ionographic or ionic projection writing head 7*a* to be developed with a first color, which latent image is then developed with a first developer at a development housing 9*a* situated at station A. Development may be either with a liquid developer containing a release agent or with a dry developer containing a release agent; as illustrated in FIG. 5, the process employs liquid development. Stations A, B, C, and D each comprise an ionographic writing head 7*a*, 7*b*, 7*c*, and 7*d*, a development station 9*a*, 9*b*, 9*c*, and 9*d*, means, such as a solid porous roll, for removing excess liquid vehicle 11*a*, 11*b*, 11*c*, and 11*d*, a means to neutralize charge 13*a*, 13*b*, 13*c*, and 13*d*, and, optionally, means for conditioning the image such as, for example, a heating means (not shown). When dry development processes are employed, liquid removal means 11 is absent and can be replaced with a fusing means. The present invention may be employed to form images of a single color, in which instance only one station need be present, to form two-color images, in which instance the number of stations can be from two to as many color choices as are desired, and to form multicolor or full color images, in which instance at least three stations are present to contain cyan, magenta, and yellow developers. Preferably, when full color images are formed, a fourth station is also present at which development of black images occurs with a black developer. FIG. 5 illustrates the embodiment of the present invention wherein four stations are employed. Additional stations can be present to form and develop highlight color images, images with custom colors such as silver and gold, and the like.

Subsequent to development at station A, the toner particles adhere to imaging means 1 and the excess liquid medium from the liquid developer is removed by liquid removal means 11*a*, which may be by any of several methods, such as a counter-rotating cylinder, an air shear, or the like, before the imaging means 1 proceeds to station B. Any residual charge on the imaging means is removed by a charging means 13*a* situated at station A, which may be a corotron, RF or POW scorotron, or the like. The imaging means then proceeds to station B, at which a second latent image is formed with an ionographic or ionic projection writing head 7*b* situated at station B, which image is then developed with a second liquid developer at a development housing 9*b* situated at station B. Again, excess liquid medium from the liquid developer is removed by liquid removal means 11*b* and any residual charge on the imaging means is removed by a charging means 13*b* situated at station B. The process is repeated at stations C and D until a final full color image has been formed with cyan, yellow, magenta, and black developers, at which point a substrate 15 is moved to a pressure pinch between tensioning roller 2*c* and pressure roll 17 in synchronism with the arriving fully formed image, where pressure, heat, and, optionally, shear are applied to transfer the fully formed image to the substrate. Subsequent to transfer of the images to the substrate, imaging means 1 is cleaned by a cleaning means 19, which may be a heated roller, a blade cleaner, or the like, which cleaning means is engaged prior to cleaning and retracted subsequent to cleaning. The release agent present in the developer enables formation of images of each color on the imaging means in sequence, followed by transfer of the fully formed image to a substrate. The process can employ liquid developers, as illustrated in this Figure, or dry developers, in which instance the process would be similar except that dry development housings would be employed, and the liquid removal means 11 would be removed and optionally replaced with a fusing means. This embodiment of the present invention possesses advantages such as simplified machine architecture, in that a single imaging means is employed for preparing full color images in sequential manner, and simpler design and reduced costs in that a peel layer separate from the materials included in the developers is not necessary, thereby eliminating the need for peel layer applicators, materials, and cleaning devices.

Typically, liquid developers comprise toner particles suspended in a highly volatile liquid medium. In the process of the present invention, subsequent to development of the latent images, excess liquid medium is generally removed from the toner pile on the imaging member and returned to the developer housing by means such as a directed air knife device. The small amount of the highly volatile liquid medium remaining in the toner quickly evaporates, leaving a dry toned image on the imaging means which is difficult to separate from the imaging means. In one embodiment of the present invention as illustrated in FIG. 5, however, the liquid developer composition is modified by adding to the liquid medium a nonvolatile liquid compatible with the other developer ingredients, so that the nonvolatile portion of the liquid medium remains in the toner pile subsequent to development and removal of excess vehicle, forming a light residual oil layer between the toner pile and the imaging means. During subsequent transfer of the toned image from the imaging means to a substrate by application of heat and pressure, the oil layer acts as a release agent and promotes splitting at the imaging means-toner interface, thus enhancing transfer of the image to the substrate. Subsequent to transfer, the small amount of nonvolatile residual liquid is easily and permanently absorbed into the substrate, resulting in a dry appearance and feel. Because of the absorption flow into the substrate, the colorant is also drawn deeper into the paper structure, resulting in improved fix levels.

Suitable liquid developer compositions for this embodiment of the present invention generally comprise a liquid medium, a colorant, which may be any dye compatible with the liquid medium or any colored particles generally used in liquid developers and compatible with the liquid medium, and a charge control agent in amounts suitable for liquid development. Examples of liquid developers containing toner particles, charge control agents, and liquid media suitable for the process of the present invention are disclosed, for example, in U.S. Pat. Nos. 4,476,210, 4,794,651; 4,762,764; 3,729,419; 3,841,893 and 3,968,044, the disclosures of each of which are totally incorporated herein by reference. The liquid medium portion of the liquid developer generally comprises from about 70 to about 95 percent by weight, and preferably about 90 percent by weight, of a volatile liquid, such as the isoparaffinic hydrocarbons commercially available, for example, as Isopar® G, which exhibit a boiling point of about 156° C., a flash point of about 40° C., and a vapor pressure of about 1.9 kilopascals at 38° C. Another example of a suitable volatile liquid for this embodiment of the present invention is Isopar® L, a mixture of isoparaffinic hydrocarbons with a boiling point of from about 188° C. to about 208° C. In one embodiment of the invention, the volatile component exhibits a boiling point of 210° C. or less. The remaining 5 to 30 percent by weight, and preferably about 10 percent by weight, of the liquid vehicle comprises a nonvolatile liquid, such as the isoparaffinic hydrocarbons commercially available, for example, as Isopar® V, which exhibit a boiling point of about 255° C., a flash point of about 124° C., and a vapor pressure of about 0.03 kilopascals at 38° C. Other examples of suitable nonvolatile liquids include Magiesol® 60, available from Magie Brothers Oil Company, which exhibits a boiling point of from about 298° C. to about 361° C., and Witsol®, available from Shell Chemical Company. In one embodiment of the invention, the nonvolatile component has a boiling point of 250° C. or more. The term "volatile" as employed herein refers to a liquid that is readily vaporizable at the temperature at which development occurs, and the term "nonvolatile" as employed herein refers to a liquid that is not readily vaporizable at the temperature at which development occurs. Generally, the volatile liquid is one with a relatively low boiling point compared to the nonvolatile liquid, and evaporates readily under the imaging conditions employed with the process of the present invention. In contrast, the nonvolatile liquid generally is one with a relatively high boiling point compared to the volatile liquid, and does not evaporate readily under the imaging conditions employed with the process of the present invention. The volatile liquid, such as Isopar® G or Isopar® L, generally is selected so that it evaporates from the imaging member prior to transfer of the image to the substrate. In constrast, the nonvolatile liquid, such as Magiesol® 60 or Witsol®, generally is selected so that it does not evaporate from the imaging member prior to transfer of the image to the substrate.

The embodiment of the present invention wherein a nonvolatile liquid is included in the liquid medium of the liquid developers can be employed in a process wherein the imaging member contains no other peel layer, or it may be employed in combination with any of the other methods set forth herein for applying a peel layer to the imaging member. When a peel layer is employed, the apparatus for practicing this embodiment of the present invention can be as illustrated, for example, in FIG. 1 or FIG. 2.

Still another process for selectively applying a peel layer to the imaging member only to those areas to be subsequently developed, as illustrated in FIG. 5, entails incorporating a waxy release agent into liquid developers employed to develop the latent images. The liquid developers suitable for this embodiment of the present invention generally comprise a liquid vehicle, toner particles, a charge control additive, and a waxy release agent. The liquid medium may be any of several hydrocarbon liquids conventionally employed for liquid development processes, including hydrocarbons, such as high purity alkanes having from about 6 to about 14 carbon atoms, such as Norpar® 12, Norpar® 13, and Norpar® 15, available from Exxon Corporation, and including isoparaffinic hydrocarbons such as Isopar® G, H, L, and M, available from Exxon Corporation, Amsco® 460 Solvent, Amsco® OMS, available from American Mineral Spirits Company, Soltrol®, available from Phillips Petroleum Company, Pagasol®, available from Mobil Oil Corporation, Shellsol®, available from Shell Oil Company, and the like. Isoparaffinic hydrocarbons are preferred liquid media, since they are colorless, environmentally safe, and possess a sufficiently high vapor pressure so that a thin film of the liquid evaporates from the contacting surface within seconds at ambient temperatures. Generally, the liquid medium is present in a large amount in the developer composition, and constitutes that percentage by weight of the developer not accounted for by the other components. The liquid medium is usually present in an amount of from about 80 to about 98 percent by weight, although this amount may vary from this range provided that the objectives of the present invention are achieved.

The toner particles can be any colored particle compatible with the liquid medium, such as those contained in the developers disclosed, for example, in U.S. Pat. Nos. 4,476,210; 4,794,651; 4,762,764; 3,729,419; 3,841,893 and 3,968,044, the disclosures of each of which are totally incorporated herein by reference. The toner particles can consist solely of pigment particles, or may comprise a resin and a pigment; a resin and a dye; or a resin, a pigment, and a dye. Suitable resins include poly(ethyl acrylate-co-vinyl pyrrolidone), poly(N-vinyl-2-pyrrolidone), and the like. Other examples of suitable resins are disclosed in U.S. Pat. No. 4,476,210, the disclosure of which is totally incorporated herein by reference. Suitable dyes include Orasol Blue 2GLN, Red G, Yellow 2GLN, Blue GN, Blue BLN, Black CN, Brown CR, all available from Ciba-Geigy, Inc., Mississauga, Ontario, Morfast Blue 100, Red 101, Red 104, Yellow 102, Black 101, Black 108, all available from Morton Chemical Company, Ajax, Ontario, Bismark Brown R (Aldrich), Neolan Blue (Ciba-Geigy), Savinyl Yellow RLS, Black RLS, Red 3GLS, Pink GBLS, all available from Sandoz Company, Mississauga, Ontario, and the like. Dyes generally are present in an amount of from about 5 to about 30 percent by weight of the toner particle, although other amounts may be present provided that the objectives of the present invention are achieved. Suitable pigment materials include carbon blacks such as Microlith® CT, available from BASF, Printex® 140 V, available from Degussa, Raven® 5250 and Raven® 5720, available from Columbian Chemicals Company. Pigment materials may be colored, and may include magenta pigments such as Hostaperm Pink E (Americal Hoechst Corporation) and Lithol Scarlet (BASF), yellow pigments such as Diarylide Yellow (Dominion Color Company), cyan pigments such as Sudan Blue OS (BASF), and the like. Generally, any pigment material is suitable provided that it consists of small particles and that it combines well with any polymeric material also included in the developer composition. Pigment particles are generally present in amounts of from about 5 to about 40 percent by weight of the toner particles, and preferably from about 10 to about 30 percent by weight. The toner particles should have an average particle diameter from about 0.2 to about 10 microns, and preferably from about 0.5 to about 2 microns. The toner particles may be present in amounts of from about 1 to about 10, and preferably from about 2 to about 4 percent by weight of the developer composition.

Examples of suitable charge control agents include lecithin (Fisher Inc.); OLOA 1200, a polyisobutylene succinimide available from Chevron Chemical Company; basic barium petronate (Witco Inc.); zirconium octoate (Nuodex); aluminum stearate; salts of calcium, manganese, magnesium and zinc; heptanoic acid; salts of barium, aluminum, cobalt, manganese, zinc, cerium, and zirconium octoates; salts of barium, aluminum, zinc, copper, lead, and iron with stearic acid; and the like. The charge control additive may be present in an amount of from about 0.01 to about 3 percent by weight, and preferably from about 0.02 to about 0.05 percent by weight of the developer composition.

The waxy release agent component of the liquid developer generally can be selected from any material suitable as a peel layer material that is solid under imaging conditions, such as high molecular weight polyalkylene waxes, including polyethylene, preferably of a molecular weight of from about 500 to about 20,000, and more preferably from about 2,000 to about 10,000, Concord 5000 wax from Concord Chemical Company, Camden, N.J. hydrolyzed polyethylene polymers such as Epolene C-16, candellila wax, polyethylene, polypropylene, paraffin wax, microcrystalline wax C, Epolene N-10 and N-12, oxidized polyethylene waxes such as A-C 629 and A-C 629A, copolymers of ethylene and acrylic acid, such as A-C 580, and the like, as well as mixtures of these waxes either with or without other additives such as Nujol or oleic acid. Generally, the particles of waxy release agent are present in the liquid developer in an effective amount, preferably from about 0.5 to about 4 percent by weight.

As described, liquid developers containing a waxy release agent can comprise two kinds of toner particles, namely conventional toner particles and particles of a waxy release agent. In addition, liquid developers suitable for this embodiment of the present invention can comprise a liquid medium, a charge control agent, and particles of the waxy release agent that also contain a colorant, such as a pigment or a dye. In this embodiment, the developer contains one kind of toner particle, which particle comprises the waxy release agent and the colorant. An example of a liquid developer composition suitable for this embodiment of the present invention comprises about 10 parts by weight of a pigment, about 20 parts by weight of a hydrolyzed polyethylene, and about 170 parts by weight of an isoparaffinic hydrocarbon liquid medium such as Isopar® G, available from Exxon Company, to which is added a charge control agent such as lecithin in an amount of about 30 milligrams per gram of ink solids. Another example of a liquid developer composition suitable for this embodiment of the present invention comprises about 10 parts by weight of a pigment, about 24 parts by weight of hydrolyzed polyethylene, about 8 parts by weight of candellila wax, about 8 parts by weight of oleic acid, and about 170 parts by weight of an isoparaffinic hydrocarbon liquid medium such as Isopar® G, available from Exxon Company, to which is added a charge control agent such as lecithin in an amount of about 30 milligrams per gram of ink solids. Examples of suitable pigments include carbon black, Lithol Rubine D4566 Lake (BASF), Hostaperm Pink E (American Hoechst), Heliogen Blue NB D 7010 (BASF), Sudan Blue OS (BASF), Sico Yellow NB D 1360 (BASF), Novaperm Yellow 3010 (American Hoechst), and the like.

The liquid developers generally can be prepared by heating and mixing the ingredients, followed by grinding the mixture in an attritor in the presence of the selected liquid medium. Subsequently, the charge control agent is added to the mixture to yield the liquid developer.

Also suitable as liquid developers for this embodiment of the present invention are the developers disclosed in U.S. Pat. Nos. 4,702,985; 4,740,444; 4,707,429 and 4,798,778, the disclosures of which are totally incorporated herein by reference.

Dry toners containing a release agent can comprise either conventional toner particles to which are added transparent particles of a waxy release agent, or toner particles which comprise a waxy release agent and a colorant. In the first instance, any known toner can be employed, such as those disclosed, for example, in U.S. Pat. Nos. 4,464,252 and 4,480,021. The particles of waxy release agent generally can be selected from any material suitable as a peel layer material that is solid under imaging conditions, such as high molecular weight polyalkylene waxes, including polyethylene, preferably of a molecular weight of from about 500 to about 20,000, and more preferably from about 2,000 to about 10,000, Concord 5000 wax from Concord Chemical Company, Camden, N.J., hydrolyzed polyethylene polymers such as Epolene C-16, candellila wax, polyethylene, polypropylene, paraffin wax, microcrystalline wax C, Epolene N-10 and N-12, oxidized polyethylene waxes such as A-C 629 and A-C 629A, copolymers of ethylene and acrylic acid, such as A-C 580, and the like, as well as mixtures of these waxes either with or without other additives such as Nujol or oleic acid. These particles are generally prepared by conventional means, such as heating and mixing the ingredients, followed by the jetting, micronization, and classification steps generally employed in the electrophotographic art. The particles of waxy release agent are added to the toner in an effective amount, generally from about 5 to about 70 percent by weight. Development can be by any method, including single component development and two-component development with a suitable carrier.

Additionally, dry toner suitable for this embodiment of the present invention can comprise particles of a waxy release agent that also contain a colorant, such as a pigment or dye, wherein the waxy release agent is present in an amount of from about 50 to about 95 percent by weight and the colorant is present in an amount of from about 5 to about 50 percent by weight. These particles are generally prepared by conventional means, such as heating and mixing the ingredients, followed by the jetting, micronization, and classification steps generally employed in the electrophotographic art. If necessary, a charge control agent can be employed to charge the particles to the desired polarity. Examples of charge control agents include alkyl pyridinium halides, such as cetyl pyridinium chloride, distearyl dimethyl ammonium methyl sulfate, and those disclosed, for example, in U.S. Pat. Nos. 4,464,252 and 4,480,021. In addition, a material such as basic barium petronate, polyisobutylene succinimide, lecithin, and the like can be employed as the charge control agent.

The embodiment of the present invention wherein a release material is included in the liquid or dry developers can be employed in a process wherein the imaging member contains no other peel layer, or it can be employed in combination with any of the other methods set forth herein for applying a peel layer to the imaging member. When a peel layer is employed, the appratus for practicing this embodiment of the invention can be, for example, as shown in FIG. 1 or FIG. 2.

Specific embodiments of the invention will now be described in detail. These examples are intended to be illustrative, and the invention is not limited to the materials, conditions, or process parameters set forth in these embodiments. All parts and percentages are by weight unless otherwise indicated.

EXAMPLE I

An imaging test fixture as illustrated in FIG. 2 is equipped with an imaging member comprising 1 mil thick aluminized Mylar® polyester. To the Mylar® surface is applied a peel layer comprising 60 parts by weight of Epolene C16 (hydrolyzed polyethylene polymer available from Eastman Kodak Company), 30 parts by weight of Concord 5000 wax (colorless high melting wax available from Concord Chemical Company, Inc.), and 10 parts by weight of Nujol mineral oil. The peel layer is dissolved in a toluene solvent and solvent coated onto the Mylar® surface to form a 3 micron thick peel layer.

Subsequently, a first positively charged latent image is generated on the peel layer by an ionographic writing head in the test fixture having the capability to generate gray levels in an image by laying down varying levels of positive charge. The first image is developed with a negatively charged yellow liquid developer comprising an Isopar® G liquid vehicle, yellow toner particles in an amount of 1.5 percent by weight of the developer comprising about 20 percent by weight of Diarylide Yellow pigment and about 80 percent by weight of poly(2-ethyl hexyl methacrylate) (Polysciences, Inc.), and OLOA 1200 in an amount of about 1 percent by weight of the solids content of the developer. Subsequent to drying of the first developed image, a second positively charged latent image is generated on the peel layer on top of the first developed image by the same procedure and is developed with a negatively charged magenta liquid developer comprising an Isopar® G liquid vehicle, magenta toner particles in an amount of 1.5 percent by weight of the developer comprising about 15 percent by weight of Hostaperm Pink E pigment and about 85 percent by weight of poly(2-ethyl hexyl methacrylate) (Polysciences, Inc.), and OLOA 1200 in an amount of about 1 percent by weight of the solids content of the developer. A third positively charged image is then generated by the same process subsequent to drying of the second developed image, and is developed with a negatively charged cyan liquid developer comprising an Isopar® G liquid vehicle, cyan toner particles in an amount of 1.5 percent by weight of the developer comprising about 10 percent by weight of Sudan Blue OS pigment and about 90 percent by weight of poly(2-ethyl hexyl methacrylate) (Polysciences, Inc.), and OLOA 1200 in an amount of about 1 percent by weight of the solids content of the developer. The fully formed image is then transferred to Xerox® 4024 paper by bringing the paper into contact with the peel layer containing the image and passing the paper and imaging member through a ¼ inch pressure nip at about 100 pounds per square inch at a speed of 5 inches per second and a temperature of about 135° C. Immediately after passing through the pressure nip, the paper is separated from the imaging member while the peel layer is still warm, resulting in splitting of the peel layer approximately in half, so that the top half containing the developed image is adhered to the paper and the bottom half remains on the imaging member. The developed image is of high quality and resolution with no background deposits and excellent registration of the three primary color images, and is completely transferred to the paper. The paper bearing the transferred portion of the peel layer accepts handwriting from a ballpoint pen in all areas.

EXAMPLE II

The process of Example I is repeated with the exception that after the paper and imaging member pass through the pressure nip, the imaging member and peel layer are allowed to cool to room temperature prior to separation of the paper from the imaging member. Upon separation, the peel layer transfers completely to the paper. The developed image is of high quality and resolution with no background deposits and excellent registration of the three primary color images, and is completely transferred to the paper. The paper bearing the transferred portion of the peel layer accepts handwriting from a ballpoint pen in all areas.

EXAMPLE III

A duplex print is prepared by generating images as described in Example I and transferring the images to one side of the paper, followed by repeating the process with a new image and transferring the developed new image to the other side of the paper. The developed images are of high quality and resolution with no background deposits and excellent registration of the three primary color images, and are completely transferred to the paper. The paper bearing the transferred portions of the peel layers accepts handwriting from a ballpoint pen in all areas. Similar results are obtained by employing the transfer/separation process of Example II.

EXAMPLE IV

The process of Example I is repeated with the exception that transparency material is substituted for the paper. Immediately after passing through the pressure nip, the transparency material is separated from the imaging member while the peel layer is still warm, resulting in splitting of the peel layer approximately in half, so that the top half containing the developed image is adhered to the transparency material and the bottom half remains on the imaging member. The developed image is of high quality and resolution with no background deposits and excellent registration of the three primary color images, and is completely transferred to the transparency material. The surface of the imaged transparency that comprises the portion of transferred peel layer is smooth and uniform, and the transparency projects onto a screen an image of excellent color quality. Similar results are obtained by employing the transfer/separation process of Example II.

EXAMPLE V

A peel layer material is prepared by mixing 6.0 grams of hydrolyzed polyethylene (commercially available as Epolene C-16 from Eastman Kodak Company), 2.0 grams of candellia wax (commercially available from International Wax Company), and 2.0 grams of oleic acid (commercially available from Emery Chemical Company) in 190.0 grams of toluene and heating the mixture to 100° C. for 10 minutes until a clear solution is obtained. The solution is then coated onto a substrate of 0.92 mil aluminized Mylar® polyester with a standard vacuum holder and a Bird Coating Knife to a dry thickness of 0.3 mils to form an electroreceptor. Subsequently, an image is formed on the peel layer of the electroreceptor with an ionographic writing head in a test fixture, and the image is developed with a cyan liquid developer as described in Example I and allowed to dry. A sheet of Xerox® Series 10 Smooth paper is then placed in contact with the peel layer containing the image and a flat iron set to about 175° C. is applied to the back of the paper, resulting in transfer of the peel layer containing the image to the paper. The resulting print exhibits a glossy appearance and a wax-like feel. Subsequently, the print is heated in a convection oven set at 150° C. for 1 minute, after which time it is removed and cooled to room temperature, resulting in the print losing its gloss and waxy feel.

EXAMPLE VI

A transparent waxy liquid toner is prepared by mixing together 60 parts by weight of hydrolyzed polyethylene (commercially available as Epolene C-16 from Eastman Kodak Company), 20 parts by weight of candellia wax (commercially available from International Wax Company), and 19.5 parts by weight of oleic acid (commercially available from Emery Chemical Company) at a temperature of 100° C. for 10 minutes and subsequently adding the mixture to an attritor containing an isoparaffinic hydrocarbon liquid (commercially available as Isopar® G from Exxon Chemical Company), resulting in the formation of a suspension of the mixture in the liquid at a 4 percent solids concentration. The suspension is then mixed with a charge control agent (commercially available as OLOA 1200 from Chevron Chemical Company) in an amount of 0.5 percent by weight of the solids content of the suspension, resulting in formation of a clear liquid toner.

Subsequently, an image is formed on a 0.92 mil aluminized Mylar® polyester substrate with an ionographic writing head in a test fixture, and the image is developed at +250 volts with the transparent liquid toner, resulting in formation of a uniform layer of the toner 0.2 mil thick in imaged areas when the transparent image has dried. The imaged substrate is then discharged with an AC scorotron to remove residual charge and a latent image is formed on the areas of the substrate bearing the transparent layer with an ionographic writing head in the test fixture. Subsequently, the image is developed with a cyan liquid developer as described in Example I and allowed to dry. A sheet of Xerox® 4024 paper is then placed in contact with the imaged areas and a warm travel iron is applied to the back of the paper, resulting in transfer of the transparent layer areas containing the cyan images to the paper.

EXAMPLE VII

A negatively charged liquid developer containing a waxy component is prepared by adding to a Union Process laboratory attritor model 01, 10 grams of Mogul L carbon black (commercially available from Cabot Corporation), 20 grams of hydrolyzed polyethylene (commercially available as Epolene C-16 from Eastman Kodak Company), and 170 grams of an isoparaffinic hydrocarbon liquid (commercially available as Isopar® G from Exxon Chemical Company). The temperature of the attritor is raised to 102° C. After 90 minutes of continuous grinding at about 100° C., the temperature is lowered to 25° C. and stirring is continued for another 90 minutes. The resulting suspension contains particles with an average diameter of about 1,480 nanometers as measured with a Brookhaven Bl 90 particle analyzer. The suspension is diluted to a concentration of 2 percent by weight solids by addition of additional Isopar® G, and a lecithin charge control agent is added to a concentration of 30 milligrams per gram of solids, resulting in formation of a black negatively charged liquid developer.

Subsequently, an image is formed on a 0.92 mil aluminized Mylar® polyester substrate with an ionographic writing head in a test fixture, and the image is developed with the black developer and allowed to dry. A sheet of Xerox® 4024 paper is then placed in contact with the imaged areas and a heated roll is applied to the back of the paper resulting in transfer of the black images to the paper.

EXAMPLE VIII

Six negatively charged liquid developers are prepared according to the method of Example VII, with the exception that instead of carbon black, the pigments are, respectively, Lithol Rubine D4566 Lake (commercially available from BASF), Hostaperm Pink E (commercially available from American Hoechst), Heliogen Blue NB D 7010 (commercially available from BASF), Sudan Blue OS (commercially available from BASF), Sico Yellow NB D 1360 (commercially available from BASF), and Novaperm Yellow 3010 (commercially available from American Hoechst). Results similar to those of Example VII are obtained when these developers are used to develop images and the dried images are transferred to paper according to the process of Example VII.

EXAMPLE IX

A negatively charged liquid developer containing a waxy component is prepared by adding to a Union Process laboratory attritor model 01, 10 grams of Mogul L carbon black (commercially available from Cabot Corporation), 24 grams of hydrolyzed polyethylene (commercially available as Epolene C-16 from Eastman Kodak Company), 8 grams of candellila wax (commercially available from Strahl & Pitsch Corporation), 8 grams of oleic acid LL233 (commercially available from Emery Industries), and 170 grams of an isoparaffinic hydrocarbon liquid (commercially available as Isopar® G from Exxon Chemical Company). The temperature of the attritor is raised to 102° C. After 90 minutes of continuous grinding at about 100° C., the temperature is lowered to 25° C. and stirring is continued for another 90 minutes. The resulting suspension contains particles with an average diameter of about 1,380 nanometers as measured with a Brookhaven Bl 90 particle analyzer. The suspension is diluted to a concentration of 2 percent by weight solids by addition of additional Isopar® G, and a lecithin charge control agent is added to a concentration of 30 milligrams per gram of solids, resulting in formation of a black negatively charged liquid developer.

Subsequently, an image is formed on a 0.92 mil aluminized Mylar® polyester substrate with an ionographic writing head in a test fixture, and the image is developed with the black developer and allowed to dry. A sheet of Xerox® 4024 paper is then placed in contact with the imaged areas and a heated roll was applied to the back of the paper, resulting in transfer of the black images to the paper.

EXAMPLE X

A transparent liquid developer is prepared by adding 170 grams of Isopar® G to a Model 01 Union process laboratory attritor containing 3/16" stainless steel balls. To this stirred mixture is added 30 grams of Epolene C-16 wax, 15 grams of Concord Wax (available from Concord Waxes of Camden, N.J.) and 5 grams of Nujol (paraffin oil available from Witco). The resulting mixture is then heated to 95° C., at which temperature a homogeneous solution is obtained. The attritor is then charged with an additonal 80 grams of Isopar® G and the temperature of the mixture is lowered to 45° C. while increasing the attritor impeller speed from 250 rpm to approximately 550 rpm. On cooling the materials precipitate and the size of the precipitated particles is then reduced to approximately one micron by the grinding action within the attritor. After approximately 2 hours, the slurry of particles is removed from the attritor, separated from the steel balls, and then diluted with 725 grams of Isopar® G. Subsequently, 0.45 gram of lecithin (a negative charge director available from Fisher Scientific Company) are added to the diluted slurry, which is then stirred to ensure complete mixing of the charge control agent. The slurry containing the charge control agent is then left standing for at least 24 hours to ensure charge stability.

A scorotron is then employed to impose 500 volts of positive charge upon an imaging member comprising an aluminized Mylar® sheet having a thickness of one mil. This "latent image", which covers the entire image area, is then developed with the transparent developer prepared as described above by applying the developer to the imaging member with a roll developement applicator. The resulting coating (approximately 3 microns thick) is then air dried. This coating is subsequently transferred to smooth plain paper in a compliant pressure nip with a pressure of about 100 pounds per square inch while the coating is heated to 120° C. resulting in complete transfer of the coating to the paper as an integral film.

EXAMPLE XI

A negatively charged cyan liquid developer is prepared by adding 170 grams of Isopar® G to a Model 01 Union process laboratory attritor containing 3/16" stainless steel balls. To this stirred mixture is added 30 grams of Epolene C-16 wax, 15 grams of Concord Wax (available from Concord Waxes of Camden, N.J.), 5 grams of Nujol (paraffin oil available from Witco), and 2.5 grams of Heliogen Blue N7010 cyan pigment (available from BASF). The resulting mixture is then heated to 95° C., at which temperature a homogeneous solution is obtained. The attritor is then charged with an additional 80 grams of Isopar® G and the temperature of the mixture is lowered to 45° C. while increasing the attritor impeller speed from 250 rpm to approximately 550 rpm. On cooling the materials precipitate and the size of the precipitated particles is then reduced to approximately one micron by the grinding action within the attritor. After approximately 2 hours, the slurry of particles is removed from the attritor, separated from the steel balls, and then diluted with 725 grams of Isopar® G. Subsequently, 0.45 gram of lecithin (charge director available from Fisher Scientific Company) is added to the diluted slurry, which is then stirred to ensure complete mixing of the charge control agent. The slurry containing the charge control agent is then left standing for at least 24 hours to ensure charge stability.

An imaging member comprising a sheet of 1 mil thick aluminized Mylar® uniformly cloated with 3 microns of the clear developer of Example X is then imaged with an ionographic writing device and then developed with the cyan developer. This developed image is allowed to dry and is then fully transferred to paper in a compliant pressure nip with a pressure of about 100 pounds per square inch while the coating is heated to 120° C. The layer of transparent developer under the cyan image is fully transferred to the paper and forms a protective overcoating for the image.

EXAMPLE XII

Two transparent liquid developer formulations are prepared according to the method of Example X with the exception that different amounts of Epolene C-16 polymer, Concord Wax 5000, and Nujol are employed. The first transparent liquid developer contains 40 grams of Epolene C-16 polymer, 7.5 grams of Concord Wax 5000, and 2.5 grams of Nujol. The second transparent liquid developer contains 45 grams of Epolene C-16 polymer, no Concord 5000 wax, and 5 grams of Nujol.

A scorotron is then employed to impose 500 volts of positive charge upon an imaging member comprising an aluminized Mylar® sheet having a thickness of one mil. This "latent image", which covers the entire image area, is then developed with the first transparent developer prepared as described above by applying the developer to the imaging member with a roll development applicator. The resulting coating (approximately 3 microns thick) is then air dried. This coating is subsequently transferred to smooth plain paper in a compliant pressure nip with a pressure of about 100 pounds per square inch while the coating is heated to 120° C. resulting in complete transfer of the coating to the paper as an integral film. Similar results are obtained when the second transparent developer prepared as described above is employed.

EXAMPLE XIII

Additional liquid developers are prepared according to the method of Example XI with the exception that the amount and/or identity of the pigment is varied. Specifically, liquid developers with the following pigments and concentratins are prepared: (1) Heliogen Blue N7010, 2.5 grams; (2) Black Pearls L pigment (Mobay Chemical Company), 2.5 grams; (3) Heliogen Blue N7010, 5 grams; (4) Black Pearls L, 5 grams; (5) Heliogen Blue N7010, 10 grams; (6) Black Pearls L, 10 grams; (7) Heliogen Blue N7010, 15 grams; (8) Black Pearls L, 15 grams; (9) Heliogen Blue N7010, 25 grams; and (10) Black Pearls L, 25 grams. Employing these developers in the process set forth in Example XI to form cyan and black images yields substantially similar results to those of Example XI.

EXAMPLE XIV

A hot melt peel layer coating formulation is prepared by heating 30 grams of Epolene C-16, 10 grams of candellila wax, and 10 grams of Nujol to about 120° C. for 10 minutes while mechanically mixing the blend. The clear molten mixture, the components of which are completely compatible with each other, is then cooled while continuing the mechanical mixing to maintain the homogeneity of the mixture. At ambient temperature, the white solid is then chopped into small pieces for the hot melt coating application.

A sheet of 0.92 mil aluminized Mylar® is then placed on a vacuum plate heated to 130° C., and a 0.5 mil Bird applicator bar is placed on the heated surface and allowed to reach a temperature greater than 70° C. the chopped mixture prepared above is then applied to the surface of the Mylar® and allowed to melt, after which it is spread across the Mylar® at a uniform thickness of 0.5 mil by drawing the Bird applicator over the molten material. The Mylar® is subsequently removed from the vacuum plate, and the applied liquid film forms a clear, malleable film which adheres well to the Mylar® surface. The dielectric quality of this layer is determined by charging the surface to +500 volts with a scorotron and then measuring the voltage decay as a function of time. The leakage rate is about 5 volts per second. This clear film is then transferred from the aluminized Mylar® to Xerox® Series 10 smooth paper by the application of heat and pressure using a flat iron set to 143° C. applied to the back of the paper.

EXAMPLE XV

Additional hot melt formulations are prepared by the method of Example XIV with the exception that various waxes are substituted for the candillela wax and in some cases oleic acid is substituted for the Nujol. The amount of wax is varied between 10 and 30 percent by weight and the amount of additive (oleic acid or Nujol) is varied between 5 and 10 percent by weight. Specific examples of the hot melt formulations include:

1. 30 grams Epolene C-16, 10 grams paraffin wax (melting point 71° F.), and 10 grams Nujol
2. 35 grams Epolene C-16, 5 grams paraffin wax (melting point 71° F.), and 10 grams Nujol
3. 30 grams Epolene C-16, 10 grams paraffin wax (melting point 71° F.), and 10 grams oleic acid
4. 30 grams Epolene C-16, 10 grams microcrystalline wax C, and 10 grams Nujol
5. 35 grams Epolene C-16, 5 grams microcrystalline wax C, and 10 grams Nujol
6. 30 grams Epolene C-16, 10 grams microcrystalline wax C, and 10 grams oleic acid
7. 30 grams Epolene C-16, 10 grams Concord Wax 5000, and 10 grams Nujol
8. 35 grams Epolene C-16, 5 grams Concord Wax 5000, and 10 grams Nujol
9. 30 grams Epolene C-16, 10 grams Concord Wax 5000, and 10 grams oleic acid
10. 32.5 grams Epolene C-16, 7.5 grams Concord Wax 5000, and 10 grams Nujol
11. 25 grams Epolene C-16, 15 grams Concord Wax 5000, and 10 grams Nujol
12. 35 grams Epolene C-16, 10 grams Concord Wax 5000, and 5 grams Nujol
13. 27.5 grams Epolene C-16, 17.5 grams Concord Wax 5000, and 5 grams Nujol.

The dielectric properties of the various coatings are influenced by the choice of wax and oil. The coatings containing Nujol exhibit superior dielectric properties compared to those containing oleic acid. Preferred formulations with respect to appearance and transfer behavior contain between 15% and 30% Concord wax and between 5% and 10% Nujol in combination with the Epolene C-16.

EXAMPLE XVI

Additional hot melt peel layer coating formulations are prepared containing formulations 7, 8, 10, 11, 12, and 13 of Example XV by adding 340 grams of toluene to a Model 01 Union process laboratory attritor containing 3/16" stainless steel balls. To this stirred mixture is added 50 grams of the selected formulation from Example XV. The resulting solution is then heated to 95° C., at which temperature a homogeneous solution is obtained. The attritor is then changed with an additional 160 grams of toluene and the temperature of the solution is lowered to 70° C. After approximately 2 hours, the solution is removed from the attritor and diluted with 725 grams of toluene. Subsequently, 0.45 gram of lecithin (a negative charge director available from Fisher Scientific Company) are added to the diluted solution, which is then stirred to ensure complete mixing of the charge control agent. The slurry containing the charge control agent is then left standing for at least 24 hours to ensure charge stability.

A scorotron is then employed to impose 500 volts of positive charge upon an imaging member comprising an aluminized Mylar® sheet having a thickness of one mil. This "latent image", which covers the entire image area, is then developed with the transparent developer prepared as described above by applying the developer to the imaging member with a roll development applicator. The resulting coating (approximately 3 microns thick) is then air dried. This coating is subsequently transferred to smooth plain paper in a compliant pressure nip with a pressure of about 100 pounds per square inch while the coating is heated to 120° C. resulting in complete transfer of the coating to the paper as an integral film.

EXAMPLE XVII

Additional hot melt peel layer coating formulations are prepared containing formulations 7, 8, 10, 11, 12, and 13 of Example XV by adding 340 grams of toluene to a Model 01 Union process laboratory attritor containing 3/16" stainless steel balls. To this stirred mixture is added 50 grams of the selected formulation from Example XV. The resulting mixture is then heated to 95° C., at which temperature a homogeneous solution is obtained. The attritor is then charged with an additional 160 grams of toluene and the temperature of the mixture is lowered to ambient temperature while increasing the attritor impeller speed from 250 rpm to approximately 550 rpm. On cooling the materials precipitate and the size of the precipitated particles is then reduced to approximately one micron by the grinding action within the attritor. After approximately 2 hours, the slurry of particles is removed from the attritor, separated from the steel balls, and then diluted with 725 grams of toluene. Subsequently, 0.45 gram of lecithin (a negative charge director available from Fisher Scientific Company) are added to the diluted slurry, which is then stirred to ensure complete mixing of the charge control agent. The slurry containing the charge control agent is then left standing for at least 24 hours to ensure charge stability.

A scorotron is then employed to impose 500 volts of positive charge upon an imaging member comprising an aluminized Mylar® sheet having a thickness of one mil. This "latent image", which covers the entire image area, is then developed with the transparent developer prepared as described above by applying the developer to the imaging member with a roll development applicator. The resulting coating (approximately 3 microns thick) is then air dried. This coating is subsequently transferred to smooth plain paper in a compliant pressure nip with a pressure of about 100 pounds per square inch while the coating is heated to 120° C. resulting in complete transfer of the coating to the paper as an integral film.

EXAMPLE XVIII

An imaging test fixture as illustrated in FIG. 5 is equipped with an imaging member comprising 1 mil thick aluminized Mylar® polyester. Subsequently, a first positively charged latent image is generated on the imaging member by an ionographic writing head. The first image is developed with a negatively charged yellow liquid developer which comprises a liquid vehicle comprising 90 percent by weight of Isopar® G and 10 percent by weight of Isopar® V, yellow toner particles in an amount of about 1.5 percent by weight of the developer comprising about 20 percent by weight of Diarylide Yellow pigment and about 80 percent by weight of Pliolite® OMS resin (vinyl toluene acrylic copolymer available from the Goodyear Tire and Rubber Company), and OLOA 1200 in an amount of about 0.5 percent by weight of the solids content of the developer. Subsequently, when the first image has dried, a second positively charged latent image is generated on the imaging member on top of the first developed image by the same procedure and is developed with a negatively charged magenta liquid developer which comprises a liquid vehicle comprising 90 percent by weight of Isopar® G and 10 percent by weight of Isopar® V, magenta toner particles in an amount of about 1.5 percent by weight of the developer comprising about 15 percent by weight of Hostaperm Pink E pigment and about 85 percent by weight of Pliolite® OMS resin (vinyl toluene acrylic copolymer available from the Goodyear Tire and Rubber Company), and OLOA 1200 in an amount of about 0.5 percent by weight of the solids content of the developer. A third positively charged image is then generated by the same process and is developed with a negatively charged cyan liquid developer which comprises a liquid vehicle comprising 90 percent by weight of Isopar® G and 10 percent by weight of Isopar® V, cyan toner particles in an amount of about 1.5 percent by weight of the developer comprising about 10 percent by weight of Sudan Blue OS pigment and about 90 percent by weight of Pliolite® OMS resin (vinyl toluene acrylic copolymer available from the Goodyear Tire and Rubber Company), and OLOA 1200 in an amount of about 0.5 percent by weight of the solids content of the developer. The fully formed image is then transferred to Xerox® 4024 paper by bringing the paper into contact with the imaging member and passing the paper and imaging member through a ¼ inch pressure nip at about 100 pounds per square inch at a speed of 5 inches per second and a temperature of about 135° C. The developed image is of high quality and resolution with no background deposits and excellent registration of the three primary color images, and is completely transferred to the paper.

Other embodiments and modifications of the present invention may occur to those skilled in the art subsequent to a review of the information presented herein; these embodiments and modifications, as well as equivalents thereof, are also included within the scope of this invention.

What is claimed is:

1. An imaging process which comprises providing an imaging means; applying to the imaging means a liquid material capable of forming a dielectric peel layer adhering to the imaging means; forming a latent image on the peel layer with an ionographic writing means; developing the latent image; contacting a substrate to the peel layer; and simultaneously transferring the peel layer containing the developed image from the imaging means to the substrate and affixing the peel layer containing the developed image to the substrate.

2. A process according to claim 1 wherein the peel layer comprises a wax material.

3. A process according to claim 1 wherein the peel layer comprises a material selected from the group consisting of polyalkylene waxes, candellila wax, microcrystalline wax, paraffin waxes, hydrolyzed polyalkylene waxes, oxidized polyalkylene waxes, copolymers of ethylene and acrylic acid, Concord Wax 5000, and mixtures thereof.

4. A process according to claim 3 wherein the peel layer contains an additive material selected from the group consisting of mineral oils, fatty acids, silicon dioxide particles, and mixtures thereof.

5. A process according to claim 1 wherein the peel layer has a thickness of from about 1 to about 20 microns.

6. A process according to claim 1 wherein the imaging means comprises a conductive layer and a dielectric layer.

7. A process according to claim 6 wherein the imaging means comprises aluminized polyester.

8. A process according to claim 6 wherein the dielectric material is selected from the group consisting of vinylidene fluoride-based fluoroelastomers, polytetrafluoroethylene, polyvinylidene fluoride, polyvinyl fluoride, polycarbonates, polyesters, and mixtures thereof.

9. A process according to claim 8 wherein the conductive layer of the imaging means comprises nickel.

10. A process according to claim 6 wherein the peel layer has a thickness of from about 1 to about 6 microns.

11. A process according to claim 1 wherein the imaging means is conductive.

12. A process according to claim 11 wherein the peel layer has a thickness of from about 6 to about 20 microns.

13. A process according to claim 1 wherein a second latent image is formed and developed on the imaging means subsequent to formation and development of the first image and prior to transfer of the peel layer to the substrate.

14. A process according to claim 1 wherein the image is developed with a liquid developer.

15. A process according to claim 1 wherein the image is developed with a dry developer and the developed image is affixed to the peel layer.

16. A process according to claim 1 wherein the peel layer splits during transfer to the substrate so that a portion of the peel layer containing the developed image is transferred to the substrate and a portion of the peel layer without a developed image remains on the imaging means subsequent to transfer.

17. A process according to claim 16 wherein transfer of the portion of the peel layer bearing the developed image to the substrate is assisted by heating the peel layer to a temperature of at least its melting point, and the substrate is separated from the imaging means while at least a portion of the peel layer is at a temperature of at least its melting point.

18. A process according to claim 1 wherein the peel layer transfers from the imaging means to the substrate substantially in its entirety.

19. A process according to claim 18 wherein the substrate is separated from the imaging means at a temperature below the melting point of the peel layer.

20. A process according to claim 1 wherein the peel layer is transferred to the substrate by applying pressure to the substrate while it is in contact with the peel layer.

21. A process according to claim 1 wherein the peel layer is transferred to the substrate by applying heat to the peel layer while it is in contact with the substrate.

22. A process according to claim 1 wherein the peel layer is transferred to the substrate by applying heat to the substrate while it is in contact with the peel layer.

23. A process according to claim 1 wherein a substantially transparent adhesive material is applied to the peel layer prior to transfer to the substrate.

24. A process according to claim 1 wherein the substrate is coated with an adhesive material on the surface in contact with the peel layer.

25. A process according to claim 1 wherein the peel layer is transferred to the substrate by charging the peel layer to one polarity and charging the substrate to the opposite polarity.

26. A process according to claim 1 wherein the substrate is heated subsequent to transfer of the peel layer to the substrate to enable the peel layer to penetrate the substrate, thereby reducing image gloss.

27. A process according to claim 1 wherein the imaging means is cleaned of residual peel layer subsequent to transfer of the peel layer to the substrate.

28. A process according to claim 1 wherein the peel layer is applied to the imaging means by forming a latent image on the imaging means corresponding to areas that will subsequently be imaged, followed by developing the latent image with a liquid material containing a dopant to render said liquid material conductive in its liquid state, and subsequently permitting the liquid material to solidify, thereby depositing the peel layer in areas on the imaging means where images will be generated and developed.

29. A process according to claim 28 wherein the liquid material contains the dopant in an amount sufficient to impart to the liquid material a conductivity of from about 100 to about 1,000 picomhos.

30. A process according to claim 28 wherein the liquid material is applied to the imaging means with a gravure roller.

31. A process which comprises providing an imaging means; applying to the imaging means a material capable of forming a dielectric peel layer adhering to the imaging means; forming a latent image on the peel layer with an ionographic writing means; developing the latent image; contacting a substrate to the peel layer; and simultaneously transferring the peel layer containing the developed image from the imaging means to the substrate and affixing the peel layer containing the developed image to the substrate, wherein the peel layer is applied to the imaging means by forming a latent image on the imaging means corresponding to areas that will subsequently be imaged, followed by developing the latent image with a transparent toner, thereby depositing a peel layer which comprises the transparent toner in areas on the imaging means where images will be generated and developed.

32. A process according to claim 31 wherein the transparent toner is a liquid toner comprising a liquid vehicle, a charge control agent, and particles of a transparent waxy material.

33. A process according to claim 32 wherein the transparent waxy material is selected from the group consisting of polyalkylene waxes, candellila wax, microcrystalline wax, paraffin waxes, hydrolyzed polyalkylene waxes, oxidized polyalkylene waxes, copolymers of ethylene and acrylic acid, Concord Wax 5000, and mixtures thereof.

34. A process according to claim 31 wherein the transparent toner is a dry toner and the transparent dry toner image is affixed to the imaging means.

35. A process according to claim 34 wherein the dry toner comprises a material selected from the group consisting of polyalkylene waxes, candellila wax, microcrystalline wax, paraffin waxes, hydrolyzed polyalkylene waxes, oxidized polyalkylene waxes, copolymers of ethylene and acrylic acid, Concord Wax 5000, and mixtures thereof.

36. An imaging process which comprises applying to an imaging means a liquid material capable of forming a dielectric peel layer adhering to the imaging means; forming a first latent image on the peel layer with an ionographic writing means; developing the first latent image with a first developer; forming a second latent image on the peel layer containing the first developed image with an ionographic writing means; developing the second latent image with a second developer; forming a third latent image on the peel layer containing the first and second developed images with an ionographic writing means; developing the third latent image with a third developer; contacting a substrate to the peel layer; and simultaneously transferring the peel layer containing the developed image from the imaging means to the substrate and affixing the peel layer containing the developed image to the substrate.

37. A process according to claim 36 wherein a fourth latent image is formed and developed with a fourth developer on the peel layer subsequent to formation and development of the third image and prior to transfer of the peel layer to the substrate.

38. An imaging process which comprises forming a first latent image on an imaging means with an ionographic writing means; developing the first latent image with a first liquid developer comprising a volatile liquid component, a nonvolatile liquid component, a charge control agent, and a colorant; subsequently forming a second latent image on the imaging means bearing the first developed image with an ionographic writing means; developing the second latent image with a second liquid developer comprising a volatile liquid component, a nonvolatile liquid component, a charge control agent, and a colorant; contacting a substrate to the imaging means; and thereafter transferring the first and second developed images from the imaging means to the substrate.

39. A process according to claim 38 wherein the first and second liquid developers each contain a liquid vehicle comprising a volatile component in an amount of from about 70 to about 95 percent by weight and a nonvolatile component in an amount of from about 5 to about 30 percent by weight.

40. A process according to claim 38 wherein the volatile component has a boiling point of 210° C. or less and the nonvolatile component has a boiling point of 250° C. or more.

41. An imaging process which comprises forming a first latent image on an imaging means with an ionographic writing means; developing the first latent image with a first liquid developer comprising a volatile liquid component, a nonvolatile liquid component, a charge control agent, and a colorant; subsequently forming a second latent image on the imaging means bearing the first developed image with an ionographic writing means; developing the second latent image with a second liquid developer comprising a volatile liquid component, a nonvolatile liquid component, a charge control agent, and a colorant; subsequently forming a third latent image on the imaging means bearing the first and second developed images with an ionographic writing means; developing the third latent image with a third liquid developer comprising a volatile liquid component, a nonvolatile liquid component, a charge control agent, and a colorant; contacting a substrate to the imaging means; and thereafter transferring the first, second, and third developed images to the substrate.

42. A process according to claim 41 wherein a fourth latent image is formed on the imaging means with an ionographic writing means and developed with a fourth liquid developer comprising a volatile liquid component, a nonvolatile liquid component, a charge control agent, and a colorant subsequent to formation and development of the third image and prior to transfer of the developed images to the substrate.

43. An imaging process which comprises forming a first latent image on an imaging means with an ionographic writing means; developing the first latent image with a first developer containing a waxy release agent; subsequently forming a second latent image on the imaging means bearing the first developed image with an ionographic writing means; developing the second latent image with a second developer containing a waxy release agent; contacting a substrate to the imaging means; and thereafter simultaneously transferring the first and second developed images to the substrate and affixing the developed images to the substrate.

44. A process according to claim 43 wherein the first and second developers each comprise a liquid vehicle, colored toner particles, a charge control agent, and particles of a waxy release agent.

45. A process according to claim 44 wherein the waxy release agent is selected from the group consisting of polyalkylene waxes, candellila wax, microcrystalline wax, paraffin waxes, hydrolyzed polyalkylene waxes, oxidized polyalkylene waxes, copolymers of ethylene and acrylic acid, Concord Wax 5000, and mixtures thereof.

46. A process according to claim 43 wherein the first and second developers each comprise a liquid vehicle, a charge control agent, and particles comprising a colorant and a waxy release agent.

47. A process according to claim 46 wherein the waxy release agent is selected from the group consisting of polyalkylene waxes, candellila wax, microcrystalline wax, paraffin waxes, hydrolyzed polyalkylene waxes, oxidized polyalkylene waxes, copolymers of ethylene and acrylic acid, Concord Wax 5000, and mixtures thereof.

48. A process according to claim 43 wherein the first and second developers each comprise a dry toner comprising toner particles, a charge control agent, and particles of a waxy release agent.

49. A process according to claim 48 wherein the waxy release agent is selected from the group consisting of polyalkylene waxes, candellila wax, microcrystalline wax, paraffin waxes, hydrolyzed polyalkylene waxes, oxidized polyalkylene waxes, copolymers of ethylene and acrylic acid, Concord Wax 5000, and mixtures thereof.

50. A process according to claim 43 wherein the first and second developers each comprise a dry toner comprising a charge control agent and toner particles comprising a colorant and a waxy release agent.

51. A process according to claim 50 wherein the waxy release agent is selected from the group consisting of polyalkylene waxes, candellila wax, microcrystalline wax, paraffin waxes, hydrolyzed polyalkylene waxes, oxidized polyalkylene waxes, copolymers of ethylene and acrylic acid, and mixtures thereof.

52. An imaging process which comprises forming a first latent image on an imaging means with an ionographic writing means; developing the first latent image with a first developer containing a waxy release agent; subsequently forming a second latent image on the imaging means bearing the first developed image with an ionographic writing means; developing the second latent image with a second developer containing a waxy release agent; subsequently forming a third latent image on the imaging means bearing the first and second developed images with an ionographic writing means; developing the third latent image with a third developer containing a waxy release agent; contacting a substrate to the imaging means; and thereafter simultaneously transferring the first, second, and third developed images to the substrate and affixing the developed images to the substrate.

53. A process according to claim 52 wherein a fourth latent image is formed and developed on the imaging means with a fourth developer subsequent to formation and development of the third image and prior to transfer of the developed images to the substrate.

54. A process according to claim 52 wherein the first, second, and third developers each comprise a liquid vehicle, colored toner particles, a charge control agent, and particles of a waxy release agent.

55. A process according to claim 54 wherein the waxy release agent is selected from the group consisting of polyalkylene waxes, candellila wax, microcrystalline wax, paraffin waxes, hydrolyzed polyalkylene waxes, oxidized polyalkylene waxes, copolymers of ethylene and acrylic acid, Concord Wax 5000, and mixtures thereof.

56. A process according to claim 52 wherein the first, second, and third developers each comprise a liquid vehicle, a charge control agent, and particles comprising a colorant and a waxy release agent.

57. A process according to claim 56 wherein the waxy release agent is selected from the group consisting of polyalkylene waxes, candellila wax, microcrystalline wax, paraffin waxes, hydrolyzed polyalkylene waxes, oxidized polyalkylene waxes, copolymers of ethylene and acrylic acid, Concord Wax 5000, and mixtures thereof.

* * * * *